US010012383B2

(12) United States Patent
Hasegawa et al.

(10) Patent No.: US 10,012,383 B2
(45) Date of Patent: Jul. 3, 2018

(54) EXHAUST STRUCTURE FOR WATER HEATER

(71) Applicant: NORITZ CORPORATION, Hyogo (JP)

(72) Inventors: Takahide Hasegawa, Kakogawa (JP); Akira Iwasaki, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 883 days.

(21) Appl. No.: 14/466,406

(22) Filed: Aug. 22, 2014

(65) Prior Publication Data

US 2016/0053997 A1 Feb. 25, 2016

(51) Int. Cl.

| | |
|---|---|
| ***E04F 17/02*** | (2006.01) |
| ***F23L 17/02*** | (2006.01) |
| ***F23J 13/02*** | (2006.01) |
| ***F23J 13/04*** | (2006.01) |

(52) U.S. Cl.

CPC ..... *F23L 17/02* (2013.01); *F23J 13/02* (2013.01); *F23J 13/04* (2013.01); *F23J 2213/101* (2013.01); *F23J 2213/203* (2013.01); *F23J 2213/50* (2013.01); *F23J 2900/13021* (2013.01)

(58) Field of Classification Search

CPC ..... F26L 17/02; F26L 17/083; F26L 17/08
USPC ..... 454/1, 3–4, 35–38, 47
See application file for complete search history.

(56) References Cited

U.S. PATENT DOCUMENTS

| | | | | | |
|---|---|---|---|---|---|
| 2,522,995 | A * | 9/1950 | Coleman | F23L 17/02 454/39 |
| 3,636,853 | A * | 1/1972 | Sable | F23L 17/02 454/39 |
| 4,548,137 | A * | 10/1985 | Lane | F23L 17/02 110/184 |
| 2006/0211356 | A1 * | 9/2006 | Grassman | F23J 13/08 454/4 |

FOREIGN PATENT DOCUMENTS

| | | | |
|---|---|---|---|
| JP | S61-044247 | A | 3/1986 |
| JP | S62-001556 | Y2 | 1/1987 |
| JP | S62-042265 | Y2 | 10/1987 |
| JP | 2008-082613 | A | 4/2008 |

* cited by examiner

*Primary Examiner* — Vivek Shirsat
(74) *Attorney, Agent, or Firm* — Studebaker & Brackett PC

(57) ABSTRACT

A water heater heats water with a combustion gas. An exhaust tube includes one end portion and the other end portion, is connected to the water heater at one end portion, and inside thereof is defined as an emission path for the combustion gas. An exhaust pipe is greater in outer diameter than the exhaust tube, and a part of the exhaust tube on a side of the other end portion is introduced in the inside thereof. An exhaust terminal is attached to an end portion of the exhaust pipe and has an exhaust port for exhausting the combustion gas to the outside. An exhaust straightening member is attached to the other end portion of the exhaust tube and has an opening portion for allowing the combustion gas to flow out toward the exhaust port.

12 Claims, 25 Drawing Sheets

EXHAUST STRUCTURE FOR WATER HEATER

BACKGROUND OF THE INVENTION

Field of the Invention

The present invention relates to an exhaust structure for water heater.

Description of the Background Art

In markets, there are locations where an exhaust pipe (a B vent) already placed in a building cannot be removed from a point of view of maintaining appearance of buildings. At such a location, a water heater can be replaced by inserting a new exhaust tube (a flexible exhaust tube) in the exhaust pipe and an exhaust terminal (a rain cap) which have already been placed.

A technique for emitting an exhaust from a water heater through a roof to the outside is described, for example, in Japanese Patent Laying-Open No. 2008-82613.

In a case of a water heater of a latent heat recovery type, acidic drainage water is contained in an exhaust. Therefore, in an intake and exhaust system described in the publication above, a combustion gas emitted from a tip end portion of an exhaust tube impinges on a ceiling wall of an exhaust terminal, which results in condensation.

SUMMARY OF THE INVENTION

The present invention was made in view of the problems above, and an object thereof is to provide an exhaust structure for water heater achieving suppressed occurrence of condensation on a ceiling wall of an exhaust terminal.

An exhaust structure for water heater according to the present invention includes a water heater, an exhaust tube, an exhaust pipe, an exhaust terminal, and an exhaust straightening member. The water heater heats water with a combustion gas. The exhaust tube includes one end portion and the other end portion and is connected to the water heater at one end portion, and the inside thereof is defined as an emission path for the combustion gas. The exhaust pipe is greater in outer diameter than the exhaust tube, and a part of the exhaust tube on a side of the other end portion is introduced therein. The exhaust terminal is attached to an end portion of the exhaust pipe and has an exhaust port for exhausting the combustion gas to the outside. The exhaust straightening member is attached to the other end portion of the exhaust tube and has an opening portion for allowing the combustion gas to flow out toward the exhaust port.

According to the exhaust structure for water heater in the present invention, the exhaust straightening member has an opening portion allowing the combustion gas to flow out toward the exhaust port. Therefore, the combustion gas exhausted from the exhaust straightening member is readily emitted through the exhaust port and less likely to impinge on a ceiling wall of the exhaust terminal. Thus, occurrence of condensation caused by impingement of the combustion gas on the ceiling wall of the exhaust terminal can be suppressed.

In the exhaust structure for water heater above, the exhaust straightening member has a cylindrical circumferential wall portion having one end and the other end and a lid portion closing one end of the circumferential wall portion. The opening portion has a plurality of openings formed in the circumferential wall portion.

By thus allowing the combustion gas to flow out through a plurality of openings formed in the circumferential wall portion, the combustion gas exhausted from the exhaust straightening member is less likely to impinge on the ceiling wall of the exhaust terminal. Thus, occurrence of condensation caused by impingement of the combustion gas on the ceiling wall of the exhaust terminal can be suppressed. Since one end of the circumferential wall portion is closed by the lid portion, the combustion gas does not flow out of one end of the circumferential wall portion to impinge on the ceiling wall of the exhaust terminal. Therefore, production of drainage water due to impingement of the combustion gas which has flowed out of one end of the circumferential wall portion on the ceiling wall of the exhaust terminal can be prevented. The exhaust straightening member is arranged in the exhaust terminal. Therefore, even though the combustion gas impinges on the lid portion of the exhaust straightening member, production of drainage water can be suppressed as compared with a case that the combustion gas impinges on the ceiling wall of the exhaust terminal.

In the exhaust structure for water heater above, the lid portion has a protruding portion protruding to a side opposite to the circumferential wall portion, for securing a distance from the exhaust terminal.

This protruding portion can secure a gap between a surface of the lid portion on the one end side and the exhaust terminal, and an area of contact between the surface of the lid portion on the one end side and the exhaust terminal can be decreased. Thus, occurrence of galvanic corrosion between the surface of the lid portion on the one end side and the exhaust terminal can be suppressed.

In the exhaust structure for water heater above, a surface of the lid portion on a side of the circumferential wall portion has a surface inclined from an outer circumference to a center, downwardly toward the other end of the circumferential wall portion.

With this downwardly inclined surface, a flow of the combustion gas along a surface of the lid portion on the other end side toward the opening portion in the circumferential wall portion becomes smooth. Thus, the combustion gas can be allowed to efficiently flow out of the opening portion and exhaust resistance can be lowered. Even though drainage water is produced on the surface of the lid portion on the other end side, the drainage water readily drops into the exhaust tube as it is collected from the outer circumference toward the center, so that the drainage water can smoothly return into the exhaust tube. The center of the surface of the lid portion on the one end side can be recessed as compared with the outer circumference. Thus, since a gap is created between a central portion of the surface of the lid portion on the one end side and the ceiling wall of the exhaust terminal, occurrence of galvanic corrosion between the surface of the lid portion on the one end side and the exhaust terminal can also be suppressed.

In the exhaust structure for water heater above, the exhaust straightening member has a straightening vane attached to an inner circumferential surface of the circumferential wall portion and extending from the inner circumferential surface toward an inner circumference.

Thus, the combustion gas introduced into the exhaust straightening member is straightened so as to be guided to the circumferential wall portion along the straightening vane. Therefore, the combustion gas can be allowed to smoothly flow out of the opening portion in the circumferential wall portion and hence exhaust resistance can be lowered.

In the exhaust structure for water heater above, the circumferential wall portion has the other end part having a shape flaring toward the other end as spreading out toward an outer circumference.

Thus, the other end portion of the circumferential wall portion is formed in a flaring shape so that an inner diameter of the other end is increased. Therefore, in introducing some member from the other end side of the circumferential wall portion, that member is less likely to impinge on the other end of the circumferential wall portion and hence introduction into the circumferential wall portion is facilitated.

The exhaust structure for water heater above further includes a holding member for attaching the exhaust straightening member to the other end portion of the exhaust tube, and the holding member has elasticity.

With this holding member having elasticity, the exhaust straightening member can be attached to the exhaust tube while hermeticity between the exhaust straightening member and the exhaust tube is ensured.

In the exhaust structure for water heater above, the exhaust terminal has a connection pipe portion connected to the exhaust pipe. The holding member has an outer circumferential surface and a flange portion abutting to an inner circumferential surface of the connection pipe portion as projecting from the outer circumferential surface toward an outer circumference.

The flange portion thus abuts to the inner circumferential surface of the connection pipe portion, so that leakage of drainage water and the combustion gas from between the connection pipe portion and the holding member can be suppressed.

In the exhaust structure for water heater above, a surface of the flange portion on a side of the other end portion is inclined such that an outer circumferential side is closer toward one end portion while the holding member is attached to the exhaust tube.

The flange portion abutting to the inner circumferential surface of the exhaust pipe has the inclined surface as above, so that ease in introduction of the holding member in introducing the holding member into the exhaust pipe is enhanced.

In the exhaust structure for water heater above, the exhaust straightening member has one engagement portion which is any one of a projection and a recess and the holding member has the other engagement portion which is any other of the projection and the recess. The exhaust straightening member and the holding member are positioned and fixed as the other engagement portion is engaged with one engagement portion.

Thus, engagement between the recess and the projection can fix the exhaust straightening member and the holding member securely to each other and the exhaust straightening member and the holding member can be positioned relative to each other.

In the exhaust structure for water heater above, the holding member has a through hole and has a projection portion projecting toward an inner circumference on a circumferential surface of the through hole. The projection portion abuts to the other end portion of the exhaust tube.

Thus, in introducing the exhaust tube into the through hole in the holding member, the exhaust tube can be positioned relative to the holding member by introduction to a position where the exhaust tube abuts to the projection portion. As the exhaust tube abuts to the projection portion, the combustion gas is less likely to leak from between the exhaust tube and the holding member.

The exhaust structure for water heater above further includes an exhaust adapter arranged between an outer circumferential surface of the exhaust tube and an inner circumferential surface of the exhaust pipe and pressing both of the outer circumferential surface of the exhaust tube and the inner circumferential surface of the exhaust pipe.

With this exhaust adapter, flow-in of drainage water and the combustion gas toward the water heater through a region between the outer circumferential surface of the exhaust tube and the inner circumferential surface of the exhaust pipe can be suppressed and the exhaust tube can be supported with respect to the exhaust pipe.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to the drawings.

Embodiment 1

An exhaust structure for water heater in the present embodiment will initially be described with reference to FIGS. 1 to 3.

Figure 1:
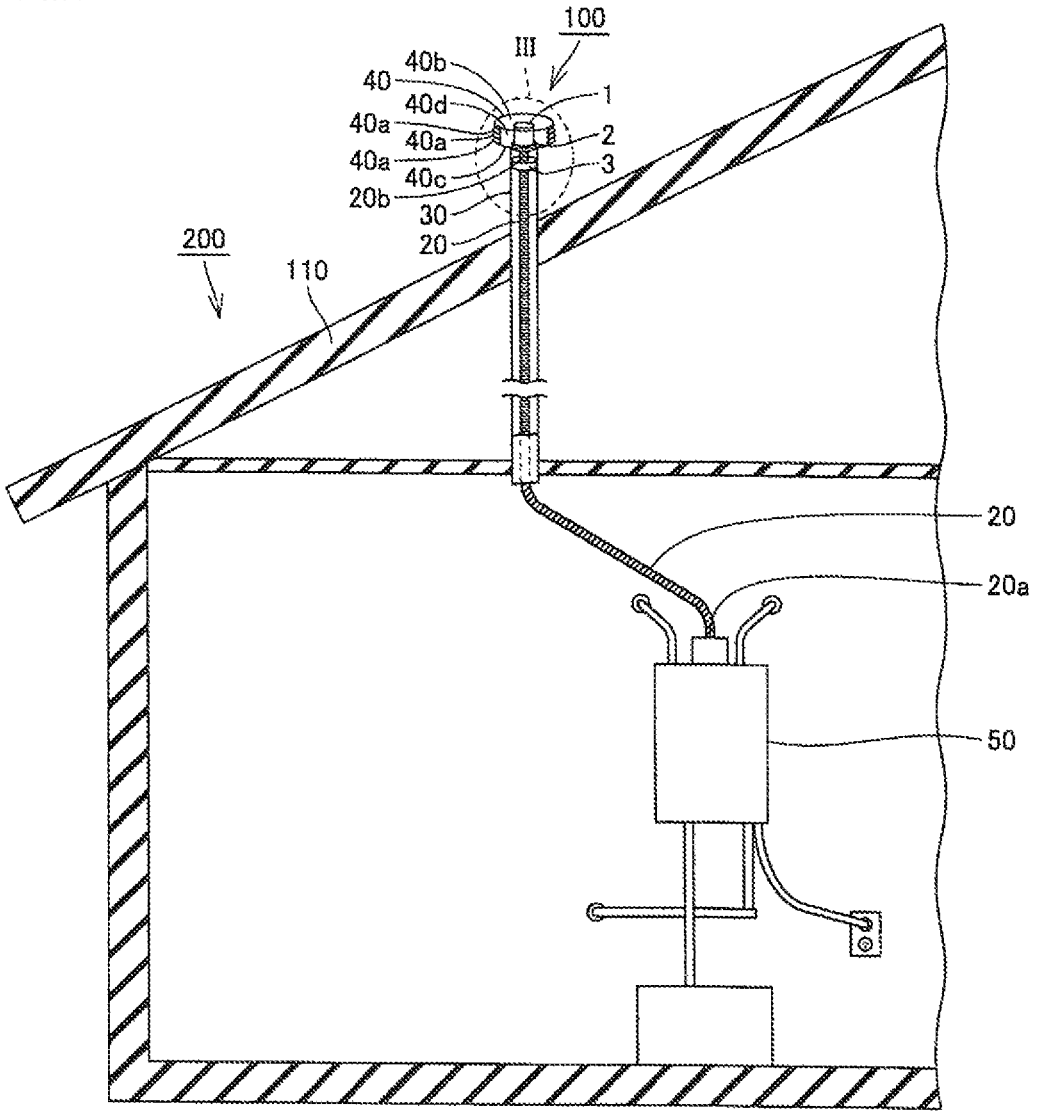
FIG. 1 is a diagram schematically showing a state that an exhaust structure for water heater in Embodiment 1 of the present invention is placed in a building.
Figure 2:
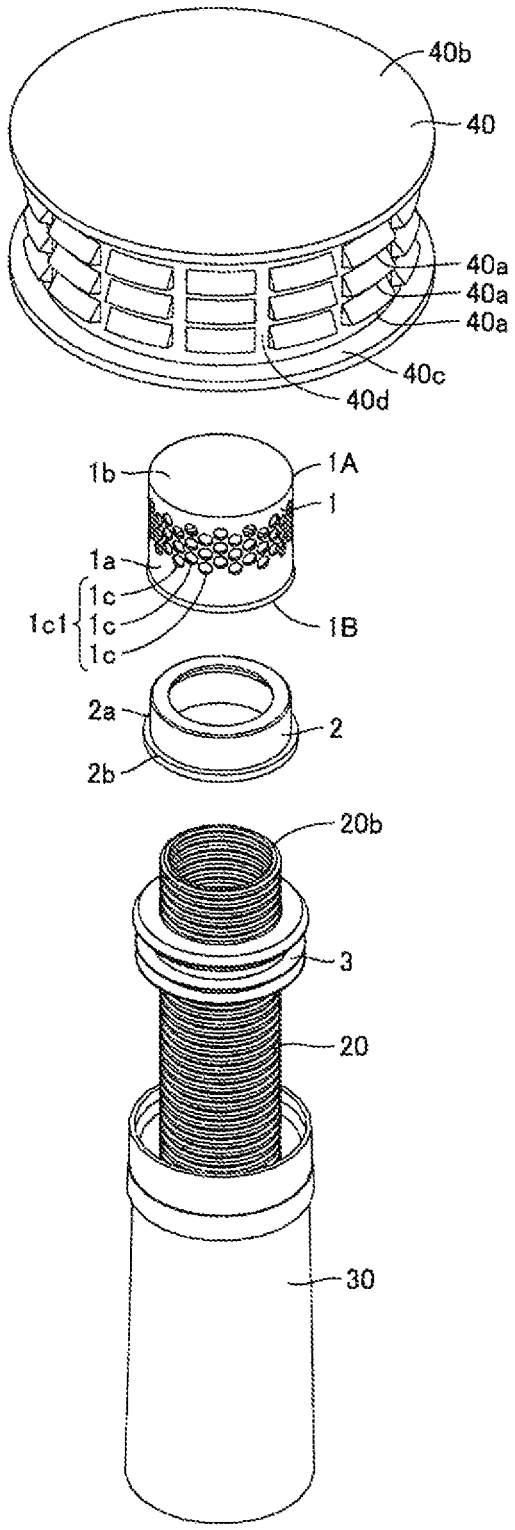
FIG. 2 is an exploded perspective view schematically showing a construction of the exhaust structure for water heater in Embodiment 1 of the present invention.
Figure 3:
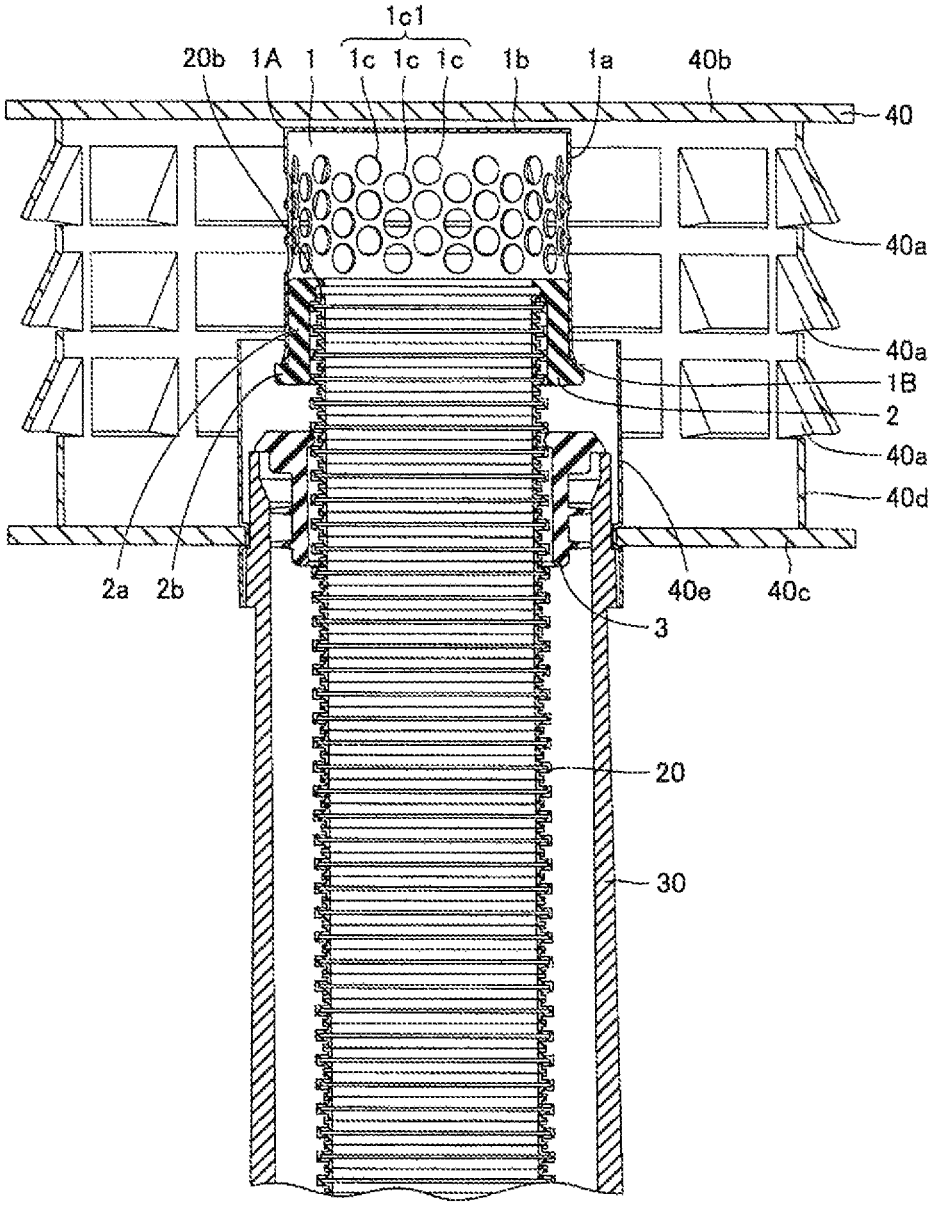
FIG. 3 is a cross-sectional view showing in an enlarged manner, a region III in FIG. 1 schematically showing the construction of the exhaust structure for water heater in Embodiment 1 of the present invention.

Referring to FIGS. 1 to 3, an exhaust structure for water heater 100 in the present embodiment mainly has an exhaust straightening member (a diffuser) 1, a holding member (a diffuser gasket) 2, an exhaust adapter 3, an exhaust tube 20, an exhaust pipe 30, an exhaust terminal 40, and a water heater 50. This exhaust structure for water heater 100 serves to emit a combustion gas produced in water heater 50 to the outside of a building 200.

Water heater 50 is placed inside building 200. This water heater 50 serves to heat water with the combustion gas and it is a water heater of a latent heat recovery type. Water heater 50 is preferably, for example, a water heater of a latent heat recovery type adapted to an exhaust suction and combustion system.

Exhaust tube 20 includes one end portion 20*a* and the other end portion 20*b*. One end portion 20*a* of exhaust tube 20 is connected to water heater 50 and the other end portion 20*b* of exhaust tube 20 extends to the outside. The inside of exhaust tube 20 is defined as an exhaust path for the combustion gas exhausted from water heater 50. Thus, the combustion gas produced in water heater 50 can be guided to the outside through exhaust tube 20. Though exhaust tube 20 is implemented as a flexible pipe such as an accordion pipe, it may be a spiral pipe.

Exhaust pipe 30 is attached to building 200 so as to extend from the inside to the outside, for example, through a roof 110 of building 200. Exhaust pipe 30 may extend from the inside to the outside through a wall. Exhaust pipe 30 is greater in outer diameter than exhaust tube 20. In the inside of this exhaust pipe 30, a part of exhaust tube 20 on a side of the other end portion 20*b* is introduced.

Exhaust terminal 40 is attached to a tip end of exhaust pipe 30 on the outdoor side. This exhaust terminal 40 has a ceiling wall 40*b*, a bottom wall 40*c*, a circumferential wall 40*d*, and a connection pipe portion 40*e* (FIG. 3). Ceiling wall 40*b* is attached to an upper end of circumferential wall 40*d*, and bottom wall 40*c* is attached to a lower end of circumferential wall 40*d*. Connection pipe portion 40*e* has a cylindrical shape and is attached to bottom wall 40*c* so as to penetrate bottom wall 40*c*. In circumferential wall 40*d*, an exhaust port 40*a* for exhausting the combustion gas to the outside (outdoors) is formed. This exhaust port 40*a* allows the combustion gas guided through exhaust tube 20 to be exhausted from exhaust terminal 40 to the outside of building 200 through exhaust pipe 30.

Connection pipe portion 40*e* of exhaust terminal 40 is connected to exhaust pipe 30. This connection pipe portion 40*e* may be an outer cover attached on an outer circumferential side of exhaust pipe 30 or an inner cover attached on an inner circumferential side of exhaust pipe 30. Exhaust terminal 40 is made, for example, of such a material as aluminum or stainless steel.

Exhaust adapter 3 serves to fix exhaust tube 20 to exhaust pipe 30. This exhaust adapter 3 is fitted to an outer circumferential surface of exhaust tube 20 and fitted to an inner circumferential surface of exhaust pipe 30. Exhaust adapter 3 has an inner circumferential surface pressing the outer circumferential surface of exhaust tube 20 while it is fitted to the outer circumferential surface of exhaust tube 20 and has an outer circumferential surface pressing the inner circumferential surface of exhaust pipe 30 while it is fitted to the inner circumferential surface of exhaust pipe 30.

Thus, the inner circumferential surface of exhaust adapter 3 is in intimate contact with the outer circumferential surface of exhaust tube 20 and the outer circumferential surface of exhaust adapter 3 is in intimate contact with the inner circumferential surface of exhaust pipe 30. Therefore, exhaust tube 20 can firmly be fixed to exhaust pipe 30 with exhaust adapter 3, and exhaust adapter 3 can prevent leakage of the combustion gas or drainage water from between exhaust tube 20 and exhaust pipe 30 and hence backflow thereof into the inside of buildings.

Holding member 2 serves to attach exhaust straightening member 1 to the other end portion 20*b* of exhaust tube 20 and it is made of a material having elasticity. This holding member 2 has a cylindrical portion 2*a* and an annular portion 2*b*. Annular portion 2*b* is attached to an end portion of cylindrical portion 2*a* and formed to project toward the outer circumference relative to cylindrical portion 2*a*. A through hole is formed so as to penetrate both of cylindrical portion 2*a* and annular portion 2*b*. As exhaust tube 20 is introduced in the through hole, holding member 2 is fitted to the outer circumferential surface of exhaust tube 20.

Exhaust straightening member 1 is fitted, for example, to the outer circumferential surface of holding member 2. As holding member 2 is fitted to exhaust tube 20 and exhaust straightening member 1 is fitted to holding member 2, exhaust straightening member 1 is attached to the other end portion 20*b* of exhaust tube 20. This exhaust straightening member 1 has a circumferential wall portion 1*a* and a lid portion 1*b*. The circumferential wall portion has a cylindrical shape having one end 1A and the other end 1B. Lid portion 1*b* is attached to one end of circumferential wall portion 1*a* so as to close one end 1A of circumferential wall portion 1*a*. The other end 1B of circumferential wall portion 1*a* is fitted to the outer circumferential surface of holding member 2 as far as a position where it abuts to annular portion 2*b* projecting toward the outer circumference relative to cylindrical portion 2*a* of holding member 2.

In circumferential wall portion 1*a*, an opening portion 1*c*1 for allowing the combustion gas to flow out toward exhaust port 40*a* of exhaust terminal 40 is formed. This opening portion 1*c*1 is constituted of a plurality of openings 1*c* and the plurality of openings 1*c* are arranged at a distance from one another. Each of the plurality of openings 1*c* is implemented as a through hole in a shape, for example, of a circle (a perfect circle, an enclosed track shape, or an ellipse), however, the shape is not limited as such and the opening may be implemented as a through hole in a polygonal shape such as a triangular shape and a rectangular shape, or a through hole in any shape. Exhaust straightening member 1 is made, for example, of such a material as stainless steel.

Water heater 50 included in exhaust structure for water heater 100 above is preferably a water heater of a latent heat recovery type, for example, adapted to an exhaust suction and combustion system, as described above. A construction of water heater 50 of the latent heat recovery type adapted to the exhaust suction and combustion system will be described below with reference to FIGS. 4 and 5.

Figure 4:
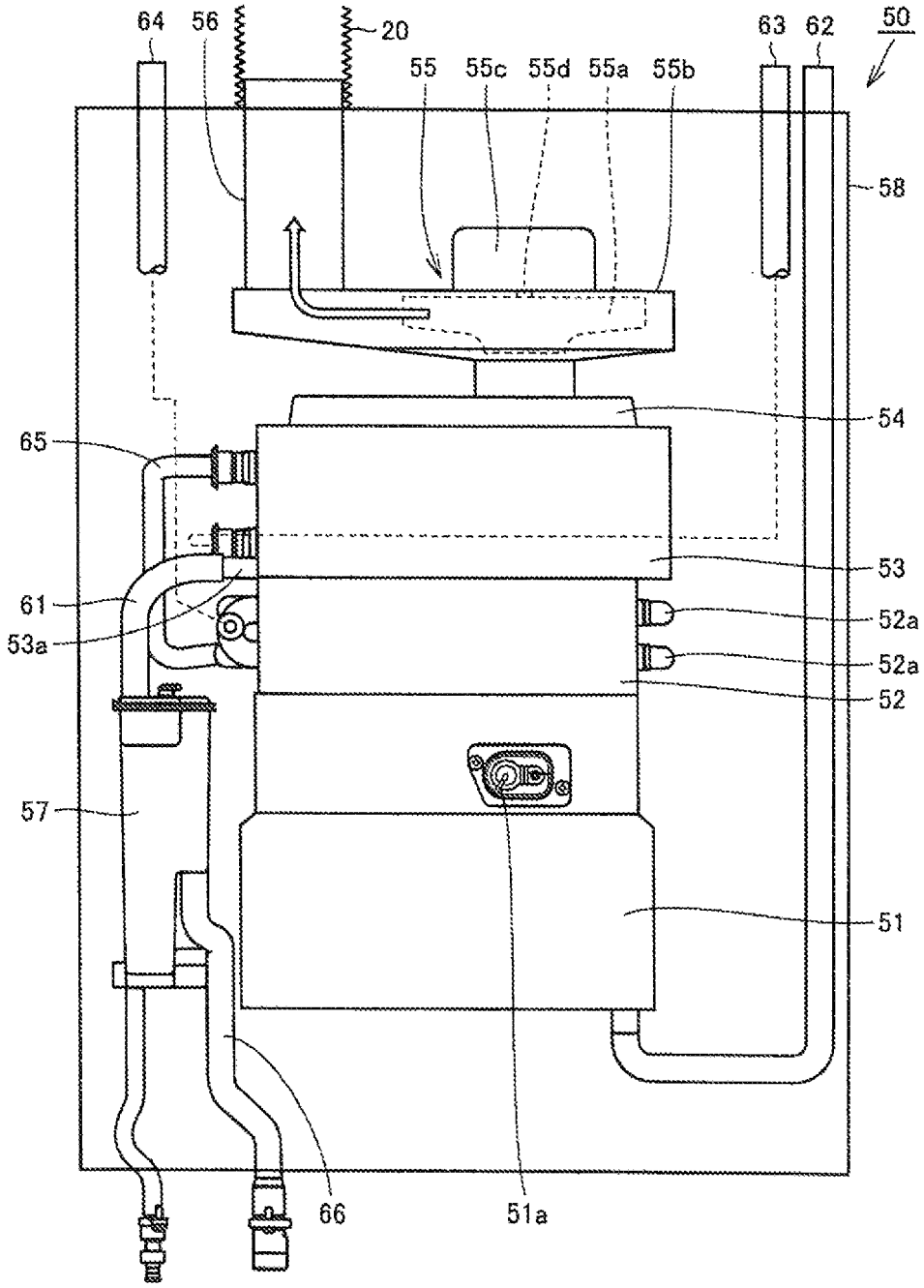
FIG. 4 is a front view schematically showing a construction of a water heater included in the exhaust structure for water heater in Embodiment 1 of the present invention.
Figure 5:
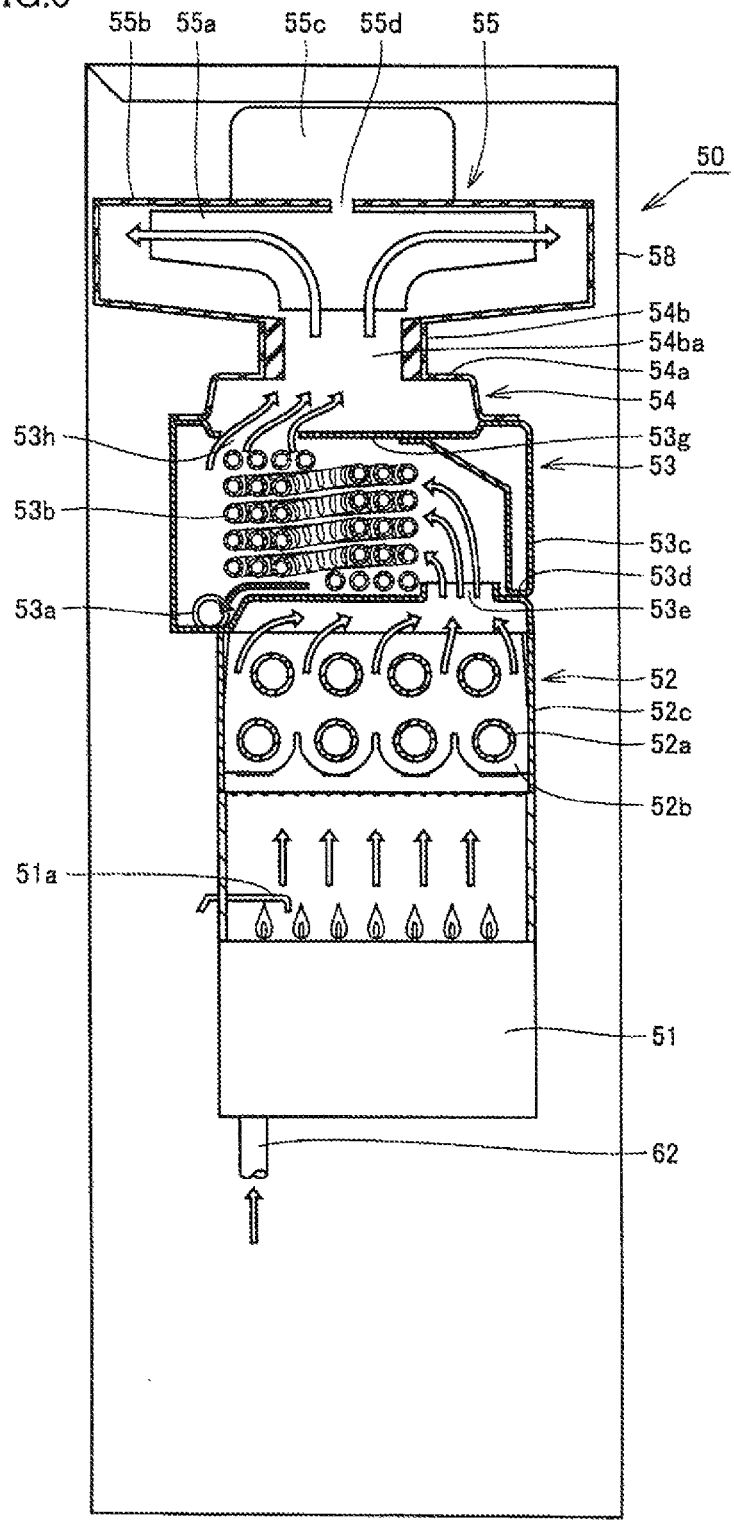
FIG. 5 is a partial side cross-sectional view schematically showing the construction of the water heater shown in FIG. 4.

Referring to FIGS. 4 and 5, water heater 50 mainly has a burner 51, a primary heat exchanger 52, a secondary heat exchanger 53, an exhaust box 54, a fan 55, a connection pipe 56, a drainage water tank 57, a housing 58, and pipes 61 to 66.

Burner 51 serves to produce a combustion gas by burning a fuel gas. A gas supply pipe 62 is connected to burner 51. This gas supply pipe 62 serves to supply a fuel gas to burner 51. A gas valve (not shown) implemented, for example, by an electromagnetic valve is attached to this gas supply pipe 62.

A spark plug 51*a* is arranged above burner 51. This spark plug 51*a* serves to ignite an air fuel mixture injected from burner 51 to thereby produce a flame, by generating sparks between the plug and a target (not shown) provided in burner 51 by activating an ignition device (an igniter). Burner 51 generates a quantity of heat by burning a fuel gas supplied from gas supply pipe 62 (which is called a combustion operation).

Primary heat exchanger 52 is a heat exchanger of a sensible heat recovery type. This primary heat exchanger 52 mainly has a plurality of plate-shaped fins 52*b*, a heat conduction pipe 52*a* penetrating the plurality of plate-shaped fins 52*b*, and a case 52*c* accommodating fins 52*b* and heat conduction pipe 52*a*. Primary heat exchanger 52 exchanges heat with the combustion gas generated by burner 51, and specifically, it serves to heat water which flows through heat conduction pipe 52*a* of primary heat exchanger 52 with the quantity of heat generated as a result of the combustion operation of burner 51.

Secondary heat exchanger 53 is a heat exchanger of a latent heat recovery type. This secondary heat exchanger 53 is located downstream of primary heat exchanger 52 in a flow of the combustion gas and connected in series with primary heat exchanger 52. Since water heater 50 according to the present embodiment thus has secondary heat exchanger 53 of a latent heat recovery type, it is water heater 50 of the latent heat recovery type.

Secondary heat exchanger 53 mainly has a drainage water discharge port 53*a*, a heat conduction pipe 53*b*, a sidewall 53*c*, a bottom wall 53*d*, and an upper wall 53*g*. Heat conduction pipe 53*b* is layered as it is spirally wound. Sidewall 53*c*, bottom wall 53*d*, and upper wall 53*g* are arranged to surround heat conduction pipe 53*b*.

In secondary heat exchanger 53, water which flows through heat conduction pipe 53*b* is pre-heated (heated) through heat exchange with the combustion gas of which heat has been exchanged in primary heat exchanger 52. As a temperature of the combustion gas is lowered to approximately 60° C. through this process, moisture contained in the combustion gas is condensed so that latent heat can be obtained. In addition, latent heat is recovered in secondary heat exchanger 53 and moisture contained in the combustion gas is condensed, whereby drainage water is produced.

Bottom wall 53*d* serves as a partition between primary heat exchanger 52 and secondary heat exchanger 53, and it also serves as an upper wall of primary heat exchanger 52. This bottom wall 53*d* is provided with an opening portion 53*e*, and this opening portion 53*e* allows communication between a space where heat conduction pipe 52*a* of primary heat exchanger 52 is arranged and a space where heat conduction pipe 53*b* of secondary heat exchanger 53 is arranged. As shown with hollow arrows in FIG. 5, the combustion gas can flow from primary heat exchanger 52 to secondary heat exchanger 53 through opening portion 53*e*. In this embodiment, for the sake of simplification, bottom wall 53*d* of secondary heat exchanger 53 and the upper wall of primary heat exchanger 52 are common, however, an exhaust collection and guide member may be connected between primary heat exchanger 52 and secondary heat exchanger 53.

Upper wall 53*g* is provided with an opening portion 53*h*, and this opening portion 53*h* allows communication between the space where heat conduction pipe 53*b* of secondary heat exchanger 53 is arranged and an internal space in exhaust box 54. As shown with hollow arrows in FIG. 5, the combustion gas can flow from secondary heat exchanger 53 into the internal space in exhaust box 54 through opening portion 53*h*.

Drainage water discharge port 53*a* is provided in sidewall 53*c* or bottom wall 53*d*. This drainage water discharge port 53*a* opens at a lowest position in the space surrounded by side wall 53*c*, bottom wall 53*d* and upper wall 53*g* (a lowermost position in a vertical direction in a state of placement of the water heater), which is lower than a lowermost portion of heat conduction pipe 53*b*. Thus, drainage water produced in secondary heat exchanger 53 can be guided to drainage water discharge port 53*a* along bottom wall 53*d* and sidewall 53*c* as shown with a black arrow in FIG. 5.

Exhaust box 54 forms a path for a flow of the combustion gas between secondary heat exchanger 53 and fan 55. This exhaust box 54 can guide the combustion gas of which heat has been exchanged in secondary heat exchanger 53 to fan 55. Exhaust box 54 is attached to secondary heat exchanger 53 and located downstream of secondary heat exchanger 53 in the flow of the combustion gas.

Exhaust box 54 mainly has a box main body 54*a* and a fan connection portion 54*b*. An internal space in box main body 54*a* communicates with the internal space where heat conduction pipe 53*b* of secondary heat exchanger 53 is arranged through opening portion 53*h* in secondary heat exchanger 53. Fan connection portion 54*b* is provided so as to protrude from an upper portion of box main body 54*a*. This fan connection portion 54*b* has, for example, a cylindrical shape, and an internal space 54*ba* thereof communicates with the internal space in box main body 54*a*.

Fan 55 serves to emit the combustion gas (of which heat has been exchanged in secondary heat exchanger 53) which has passed through secondary heat exchanger 53 to the outside of water heater 50 by suctioning the combustion gas. This fan 55 is located downstream of exhaust box 54 and secondary heat exchanger 53 in the flow of the combustion gas. Namely, in water heater 50, burner 51, primary heat exchanger 52, secondary heat exchanger 53, exhaust box 54, and fan 55 are disposed in this order from upstream to downstream in the flow of the combustion gas produced in burner 51. Since the combustion gas is suctioned and exhausted by means of fan 55 as above in this arrangement, water heater 50 in the present embodiment is the water heater adapted to the exhaust suction and combustion system.

Fan 55 mainly has a rotor 55*a*, a fan case 55*b*, a drive source 55*c*, and a rotation shaft 55*d*. Fan case 55*b* is attached to fan connection portion 54*b* of exhaust box 54 such that an internal space in fan case 55*b* and the internal space in fan connection portion 54*b* communicate with each other. Thus, as shown with hollow arrows in FIG. 5, the combustion gas can be suctioned from box main body 54*a* of exhaust box 54 through fan connection portion 54*b* into fan case 55*b*.

Rotor 55*a* is arranged in fan case 55*b*. This rotor 55*a* is connected to drive source 55*c* with rotation shaft 55*d* being interposed. Thus, rotor 55*a* is provided with drive force from drive source 55*c* and can rotate around rotation shaft 55*d*. With rotation of rotor 55*a*, the combustion gas in exhaust box 54 can be suctioned from an inner circumferential side of rotor 55*a* and can be emitted toward an outer circumferential side of rotor 55*a*.

Connection pipe 56 is connected to a region within fan case 55*b*, on the outer circumferential side of a region where rotor 55*a* is arranged. Therefore, the combustion gas emitted to the outer circumferential side of rotor 55*a* by rotor 55*a* of fan 55 can be emitted into exhaust tube 20 through connection pipe 56.

The combustion gas produced by burner 51 as above is suctioned by fan 55 with rotation of rotor 55*a* above, so that the combustion gas can reach fan 55 after passage through primary heat exchanger 52, secondary heat exchanger 53, and exhaust box 54 in this order as shown with the hollow arrows in the figure and can be exhausted to the outside of water heater 50.

Drainage water tank 57 serves to store drainage water produced in secondary heat exchanger 53. This drainage water tank 57 is connected to secondary heat exchanger 53 through pipe 61. Pipe 61 is connected to drainage water discharge port 53*a* of secondary heat exchanger 53. Thus, the drainage water produced in secondary heat exchanger 53 can be discharged to drainage water tank 57. Pipe 66 extending to the outside of water heater 50 is connected to drainage water tank 57. The drainage water stored in drainage water tank 57 can be discharged to the outside of water heater 50 through this pipe 66.

This drainage water tank 57 has a water seal structure. Namely, drainage water tank 57 has such a structure that, as a prescribed amount of drainage water is stored in drainage water tank 57, the stored drainage water cannot allow air to pass through drainage water tank 57. With such a water seal structure of drainage water tank 57, entry of air outside water heater 50 (outside air) into water heater 50 (secondary heat exchanger 53) through drainage water tank 57 via pipe 66 can be prevented.

Water supply pipe 63 is connected to one end of heat conduction pipe 53*b* of secondary heat exchanger 53 and hot water delivery pipe 64 is connected to one end of heat conduction pipe 52*a* of primary heat exchanger 52. The other end of heat conduction pipe 52*a* of primary heat exchanger 52 and the other end of heat conduction pipe 53*b* of secondary heat exchanger 53 are connected to each other through connection pipe 65. Each of gas supply pipe 62, water supply pipe 63, and hot water delivery pipe 64 leads to the outside, for example, in a top portion of water heater 50. Burner 51, primary heat exchanger 52, secondary heat exchanger 53, exhaust box 54, fan 55, and drainage water tank 57 are arranged in housing 58.

A function and effect of the present embodiment will now be described in comparison with a comparative example shown in FIG. 6.

Figure 6:
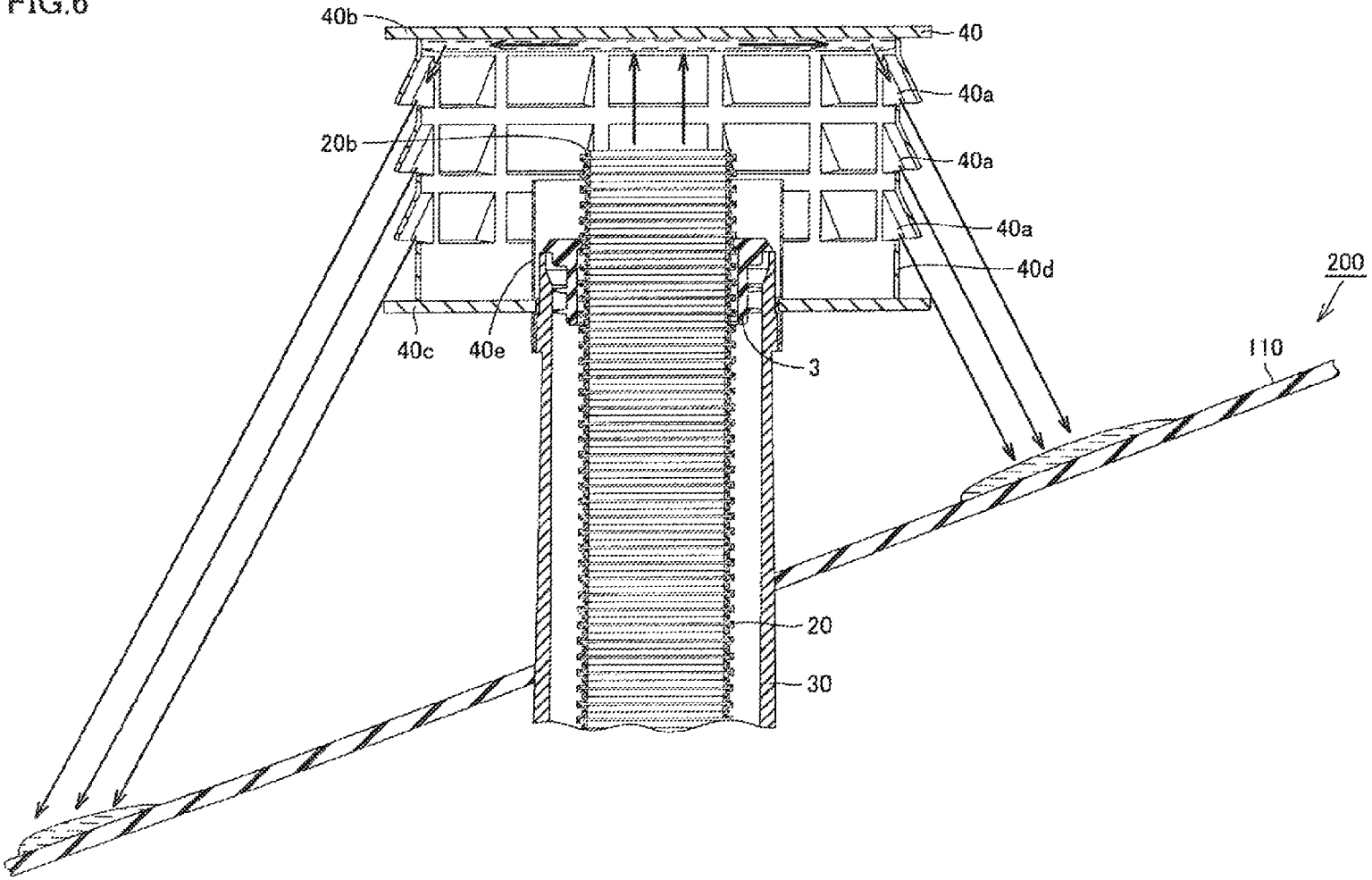
FIG. 6 is a cross-sectional view showing a manner of exhaust of a combustion gas in a construction according to a comparative example.

The comparative example shown in FIG. 6 is different in construction from the present embodiment shown in FIGS. 1 to 5 in that exhaust straightening member 1 and holding member 2 (FIGS. 2 and 3) are not provided. Therefore, the comparative example shown in FIG. 6 is constructed such that the combustion gas emitted from the other end portion 20*b* of exhaust tube 20 directly impinges on ceiling wall 40*b* of exhaust terminal 40.

After the combustion gas impinges on a central portion in ceiling wall 40*b* of the exhaust terminal, it flows toward the outer circumference of ceiling wall 40*b* and is emitted to the outside of exhaust terminal 40 through opening portion 40*a* in circumferential wall 40*d*. Therefore, the combustion gas emitted from exhaust tube 20 directly impinges on substantially the entire surface of ceiling wall 40*b* of exhaust terminal 40. Since this ceiling wall 40*b* is a portion directly exposed to outside air, it is readily affected by a temperature of the outside air. Therefore, when a temperature of the outside air is low, exhaust drainage water in the combustion gas which has impinged on ceiling wall 40*b* is cooled by ceiling wall 40*b* and a large quantity of condensation is caused.

The combustion gas emitted from opening portion 40*a* in exhaust terminal 40 maintains a relatively high velocity of flow. Therefore, the combustion gas is emitted from exhaust terminal 40 toward roof 110 of building 200 along a direction of opening of opening portion 40*a*. Thus, condensation also occurs on roof 110, which leads to corrosion of roof 110.

Furthermore, foreign matters and insects tend to enter exhaust tube 20. If exhaust terminal 40 is removed from exhaust pipe 30, raindrops directly enter exhaust tube 20.

Figure 7:
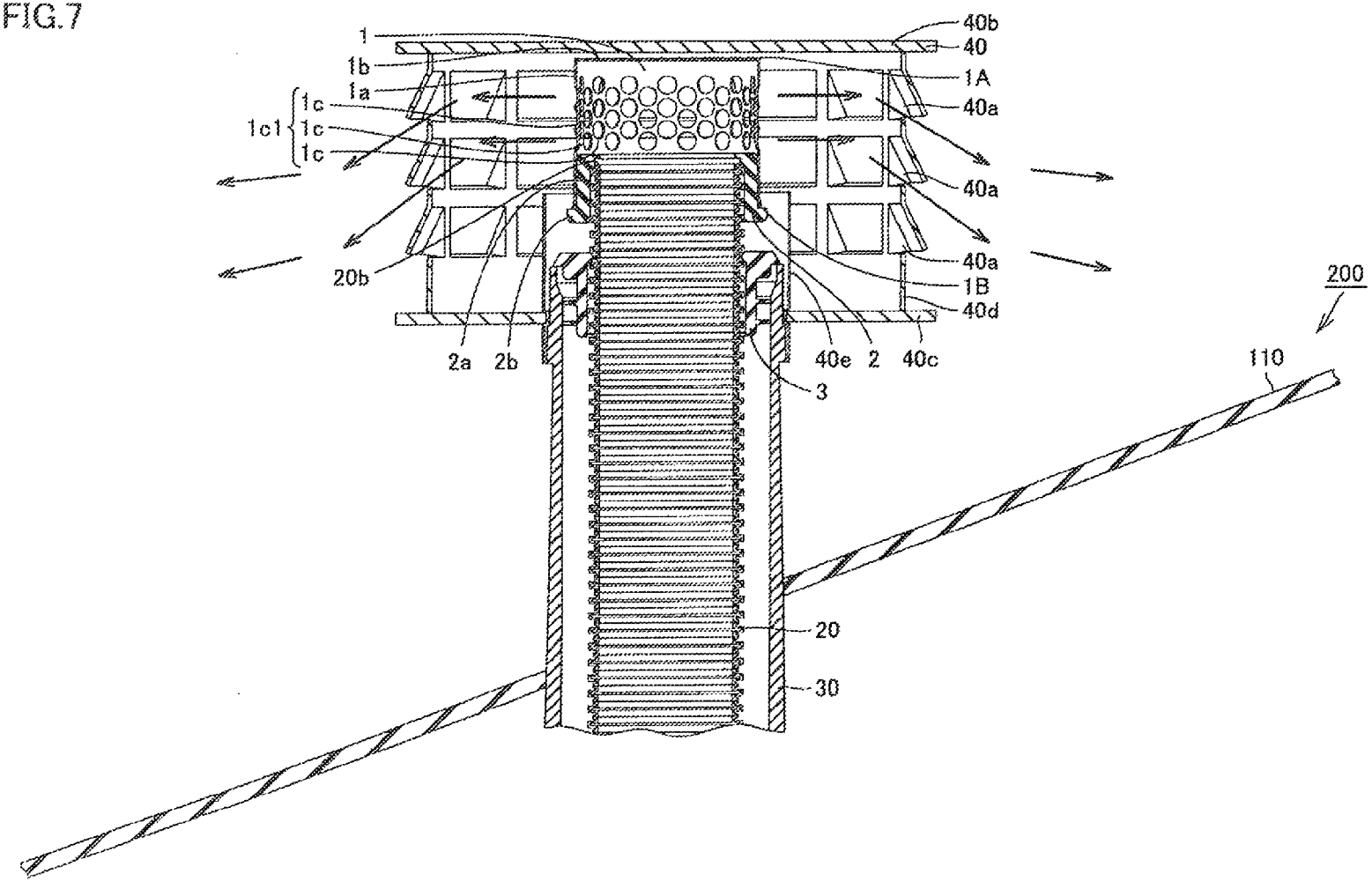
FIG. 7 is a cross-sectional view showing a manner of exhaust of the combustion gas in the exhaust structure for water heater in Embodiment 1 of the present invention.

In contrast, according to exhaust structure for water heater 100 in the present embodiment, as shown in FIG. 7, exhaust straightening member 1 is attached to the other end portion 20*b* of exhaust tube 20. This exhaust straightening member 1 has opening portion 1*c*1 allowing the combustion gas to flow out toward exhaust port 40*a* in exhaust terminal 40. Therefore, the combustion gas exhausted from exhaust straightening member 1 is readily emitted from exhaust port

40*a* and less likely to impinge on ceiling wall 40*b* of exhaust terminal 40. Therefore, occurrence of condensation caused by impingement of the combustion gas on ceiling wall 40*b* of exhaust terminal 40 can be suppressed.

An exhaust is evenly emitted by exhaust straightening member 1 so that a velocity of flow of the combustion gas emitted from exhaust straightening member 1 is also lowered. Therefore, as shown with arrows in FIG. 7, angles of the combustion gas emitted from exhaust terminal 40 toward roof 110 are more obtuse. Thus, the combustion gas emitted from exhaust terminal 40 is less likely to impinge on roof 110, condensation at roof 110 is suppressed, and corrosion of roof 110 owing to condensation is suppressed.

Opening portion 1*c*1 having a plurality of openings 1*c* is formed in circumferential wall portion 1*a* of exhaust straightening member 1. By allowing the combustion gas to flow out of the plurality of openings 1*c*, the combustion gas exhausted from exhaust straightening member 1 is less likely to impinge on ceiling wall 40*b* of exhaust terminal 40. Therefore, occurrence of condensation caused by impingement of the combustion gas on ceiling wall 40*b* of the exhaust terminal can be suppressed.

One end 1A of circumferential wall portion 1*a* of exhaust straightening member 1 is closed by lid portion 1*b*. Therefore, the combustion gas does not flow out of one end 1A of circumferential wall portion 1*a* to impinge on ceiling wall 40*b* of exhaust terminal 40. Therefore, production of drainage water due to impingement of the combustion gas which has flowed out of one end 1A of circumferential wall portion 1*a* on ceiling wall 40*b* of the exhaust terminal can be prevented.

Exhaust straightening member 1 is arranged in exhaust terminal 40 and is not directly exposed to outside air as in the case of exhaust terminal 40. Therefore, even though the combustion gas impinges on lid portion 1*b* of exhaust straightening member 1, production of drainage water can be suppressed as compared with the case that the combustion gas impinges on ceiling wall 40*b* of exhaust terminal 40.

Since exhaust straightening member 1 is attached to the other end portion 20*b* of exhaust tube 20, foreign matters and insects are less likely to enter exhaust tube 20. Even though exhaust terminal 40 is removed from exhaust pipe 30, entry of raindrops directly into exhaust tube 20 can be suppressed because one end 1A of circumferential wall portion 1*a* of exhaust straightening member 1 is closed by lid portion 1*b*.

Embodiment 2

A construction of an exhaust structure for water heater in Embodiment 2 will now be described with reference to FIGS. 8 and 9.

Figure 8:
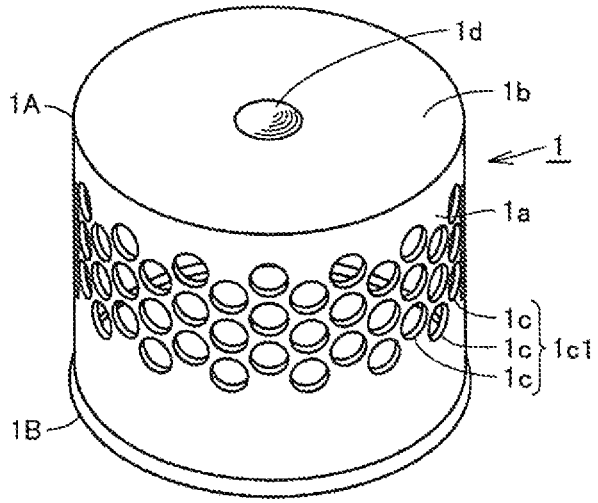
FIG. 8 is a perspective view schematically showing a construction of an exhaust straightening member included in an exhaust structure for water heater in Embodiment 2 of the present invention.
Figure 9:
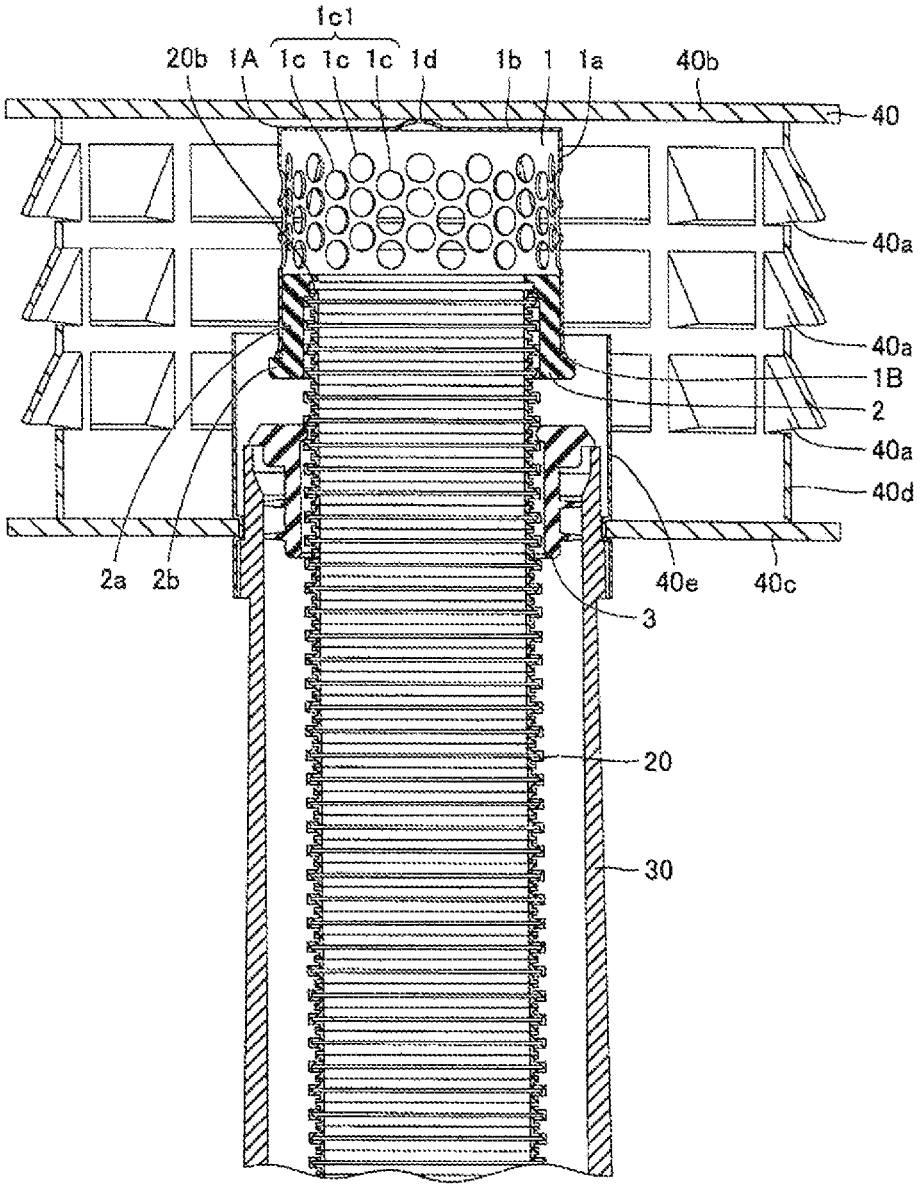
FIG. 9 is a cross-sectional view schematically showing a construction of the exhaust structure for water heater in Embodiment 2 of the present invention.

Referring to FIGS. 8 and 9, exhaust structure for water heater 100 in the present embodiment is different in construction from Embodiment 1 in that lid portion 1*b* of exhaust straightening member 1 has a protruding portion 1*d*. Lid portion 1*b* has a flat portion and protruding portion 1*d* protruding from this flat portion to a side opposite to circumferential wall portion 1*a*. As shown in FIG. 9, protruding portion 1*d* serves to secure a gap between ceiling wall 40*b* of exhaust terminal 40 and the flat portion of lid portion 1*b*. This protruding portion 1*d* has such a shape that its dimension decreases from a portion of connection to the flat portion (a root portion) toward a tip end portion. Protruding portion 1*d* may be in a shape, for example, of a dome which is substantially hemispherical, or it may be in a shape of a cone, a truncated cone, a pyramid, a truncated pyramid, a hyperboloid, or a quadric. Alternatively, protruding portion 1*d* may be formed from an L-shaped plate attached to the flat portion.

Since exhaust structure for water heater 100 in the present embodiment is otherwise substantially the same in construction as Embodiment 1, the same elements have the same reference characters allotted and description thereof will not be repeated.

As above, in markets, there are locations where already placed exhaust pipe 30 cannot be removed from a point of view of maintaining appearance of buildings. Some of already provided exhaust pipes 30 are made of a material including aluminum. Taking into account corrosion due to condensation of exhaust drainage water contained in the combustion gas, however, stainless steel is preferably employed for exhaust straightening member 1. In such a case, exhaust pipe 30 made of a material including aluminum and exhaust straightening member 1 made of stainless steel are different in type of a metal from each other. Therefore, when moisture such as drainage water is accumulated in a portion of contact between exhaust pipe 30 and exhaust straightening member 1, each of exhaust pipe 30 and exhaust straightening member 1 suffers from galvanic corrosion.

In the present embodiment, protruding portion 1*d* can secure a gap between lid portion 1*b* and ceiling wall 40*b* of exhaust terminal 40. Therefore, an area of contact between lid portion 1*b* and ceiling wall 40*b* can be made smaller than in Embodiment 1. Thus, occurrence of galvanic corrosion between lid portion 1*b* and ceiling wall 40*b* can be suppressed.

Protruding portion 1*d* can secure a gap between lid portion 1*b* and ceiling wall 40*b* of exhaust terminal 40. Therefore, heat exchange between ceiling wall 40*b* cooled by outside air and lid portion 1*b* is interfered, and hence occurrence of condensation of exhaust drainage water can also further be suppressed.

The present embodiment can also obtain an effect the same as in Embodiment 1 above.

Though a case that lid portion 1*b* is constituted of the flat portion and protruding portion 1*d* has been described above, a shape of lid portion 1*b* as a whole may be such that a central portion may protrude convexly relative to an outer circumferential portion, toward a side opposite to circumferential wall portion 1*a*. Alternatively, a shape of lid portion 1*b* as a whole may be such that a central portion is concave toward circumferential wall portion 1*a*, relative to an outer circumferential portion (that is, the outer circumferential portion of lid portion 1*b* protrudes relative to the central portion). Alternatively, lid portion 1*b* as a whole may be in a shape, for example, of a dome, or it may be in a shape of a cone, a truncated cone, a pyramid, a truncated pyramid, a hyperboloid, or a quadric.

Embodiment 3

A construction of an exhaust structure for water heater in Embodiment 3 will now be described with reference to FIGS. 10 and 11.

Figure 10:
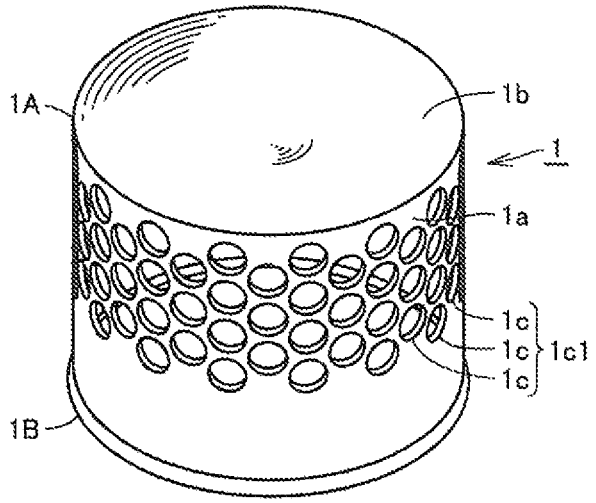
FIG. 10 is a perspective view schematically showing a construction of an exhaust straightening member included in an exhaust structure for water heater in Embodiment 3 of the present invention.
Figure 11:
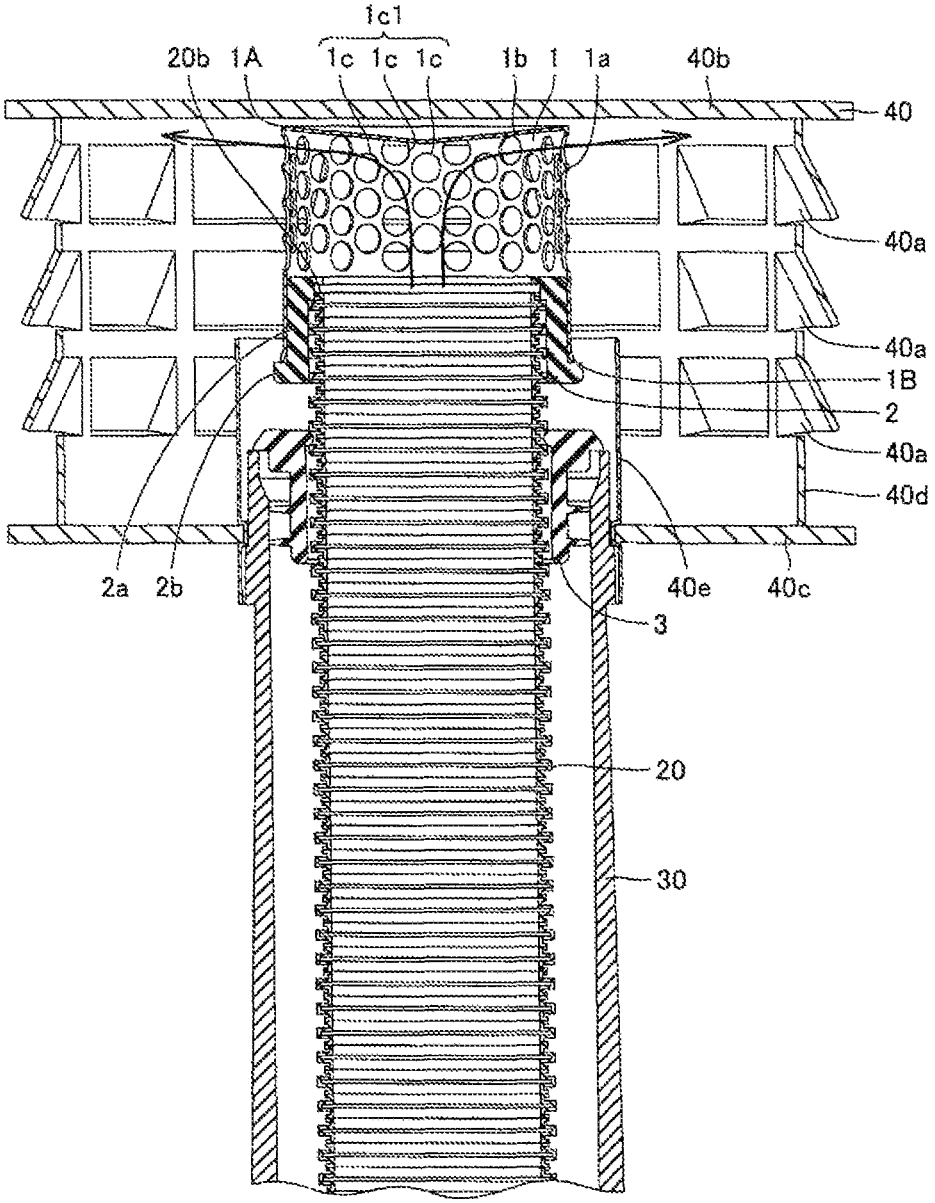
FIG. 11 is a cross-sectional view schematically showing a construction of the exhaust structure for water heater in Embodiment 3 of the present invention.

Referring to FIGS. 10 and 11, exhaust structure for water heater 100 in the present embodiment is different in construction from Embodiment 1 in that a surface of lid portion 1*b* of exhaust straightening member 1 on the side of circumferential wall portion 1*a* has a surface inclined from the outer circumference to the center, downwardly toward the other end 1B of circumferential wall portion 1*a*. The surface of lid portion 1*b* on the side of circumferential wall portion 1*a* has, for example, a conical shape. The shape of the surface of lid portion 1*b* on the side of circumferential wall portion 1*a* is not limited to the conical shape, and it may be a shape of a pyramid, a dome, a hyperboloid, a quadric, a truncated cone, or a truncated pyramid.

Since exhaust structure for water heater 100 in the present embodiment is otherwise substantially the same in construction as Embodiment 1, the same elements have the same reference characters allotted and description thereof will not be repeated.

In the present embodiment, by providing a downwardly inclined surface as a surface of lid portion 1*b* on the side of circumferential wall portion 1*a*, a flow of the combustion gas along the downwardly inclined surface toward opening portion 1*c*1 in circumferential wall portion 1*a* becomes smooth as shown with arrows in FIG. 11. Thus, the combustion gas can be allowed to efficiently flow out of opening portion 1*c*1 and exhaust resistance can be lowered. Therefore, adverse influence on the fan controlled based on a current value can be suppressed.

Even through drainage water is produced on the surface of lid portion 1*b* on the side of circumferential wall portion 1*a*, the drainage water is collected from the outer circumference to the center owing to the downwardly inclined surface. Thus, the drainage water tends to drop into exhaust tube 20 and is smoothly returned into exhaust tube 20.

The central portion of the surface of lid portion 1*b* opposite to circumferential wall portion 1*a* can be recessed concavely relative to the outer circumferential portion. Thus, since a gap is created between the central portion of the surface of lid portion 1*b* opposite to circumferential wall portion 1*a* and ceiling wall 40*b* of exhaust terminal 40, occurrence of galvanic corrosion between the surface of lid portion 1*b* opposite to circumferential wall portion 1*a* and exhaust terminal 40 can also be suppressed.

The present embodiment can also obtain an effect the same as in Embodiment 1 above.

Embodiment 4

A construction of an exhaust structure for water heater in Embodiment 4 will now be described with reference to FIGS. 12 and 13A to 13C.

Figure 12:
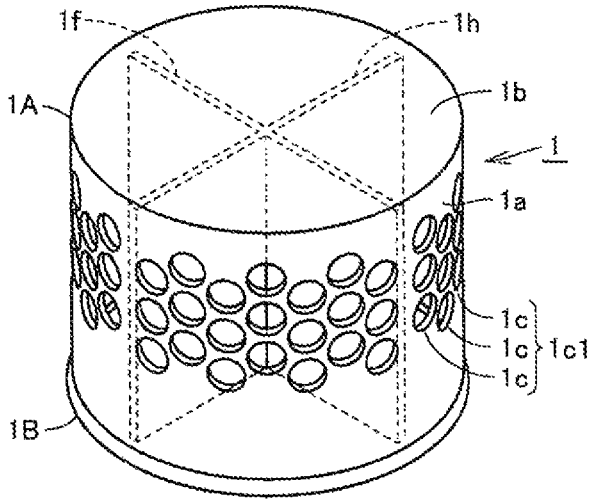
FIG. 12 is a perspective view schematically showing a construction of an exhaust straightening member included in an exhaust structure for water heater in Embodiment 4 of the present invention.
Figure 13A:
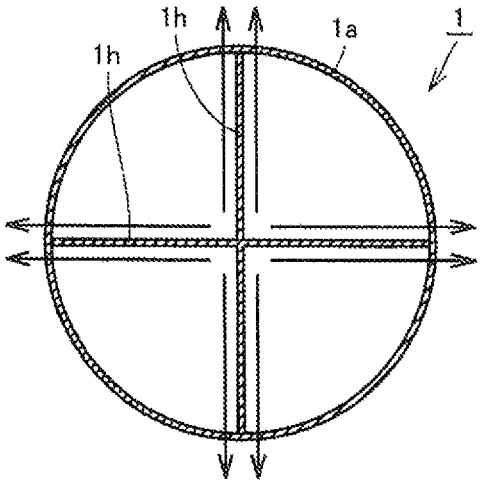
FIGS. 13A, 13B, and 13C are cross-sectional views schematically showing such constructions that straightening vanes of exhaust straightening members included in the exhaust structures for water heater in Embodiment 4 of the present invention are in a cross shape, a linear shape, and a three-way extension shape, respectively.

Referring to FIGS. 12 and 13A, exhaust structure for water heater 100 in the present embodiment is different in construction from Embodiment 1 in that exhaust straightening member 1 has a straightening vane 1*h*. Straightening vane 1*h* is attached to the inner circumferential surface of circumferential wall portion 1*a* and extends from the inner circumferential surface toward the inner circumference (central portion). In the present embodiment, straightening vane 1*h* has, for example, a cross shape in a plan view (a cross-sectional view) in a direction from one end 1A to the other end 1B of circumferential wall portion 1*a* as shown in FIG. 13A.

Figure 13B:
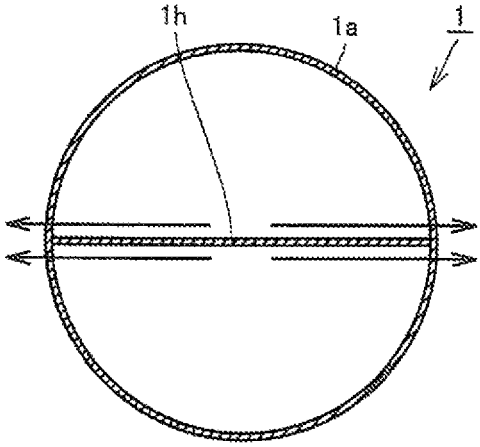
Figure 13C:
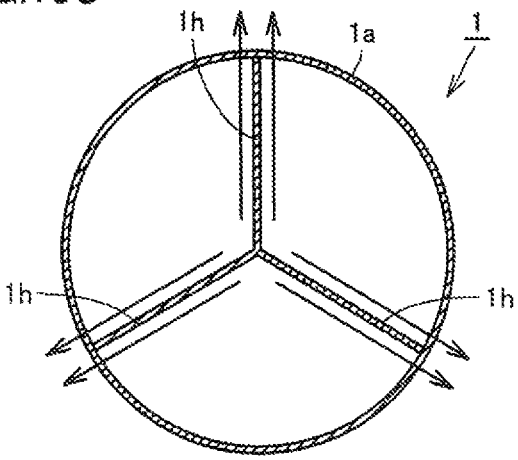

The shape of straightening vane 1*h* in the plan view is not limited to the cross shape, and it may be, for example, in a linear shape (a flat plate shape) as shown in FIG. 13B or a shape radially extending from the central portion such as three-way extension as shown in FIG. 13C.

Since exhaust structure for water heater 100 in the present embodiment is otherwise substantially the same in construction as Embodiment 1, the same elements have the same reference characters allotted and description thereof will not be repeated.

In the present embodiment, straightening vane 1*h* is arranged in a region on the inner circumferential side of circumferential wall portion 1*a* of exhaust straightening member 1, so that the combustion gas introduced in exhaust straightening member 1 is straightened to be guided to circumferential wall portion 1*a* along straightening vane 1*h* as shown with arrows in FIGS. 13A to 13C. Thus, the combustion gas can be allowed to smoothly flow out of opening portion 1*c*1 in circumferential wall portion 1*a* and exhaust resistance can be lowered. Therefore, adverse influence on the fan controlled based on a current value can be suppressed.

The present embodiment can also obtain an effect the same as in Embodiment 1 above.

Embodiment 5

A construction of an exhaust structure for water heater in Embodiment 5 will now be described with reference to FIGS. 14 and 15.

Figure 14:
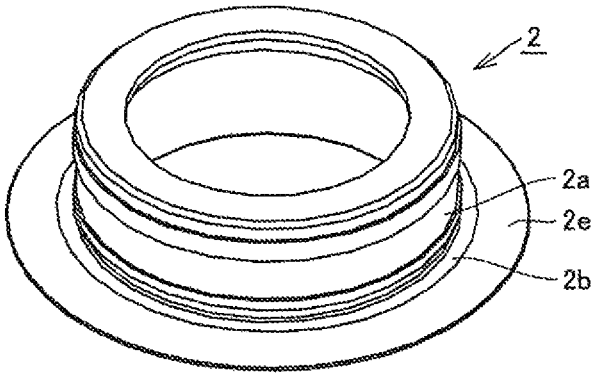
FIG. 14 is a perspective view schematically showing a construction of a holding member included in an exhaust structure for water heater in Embodiment 5 of the present invention.
Figure 15:
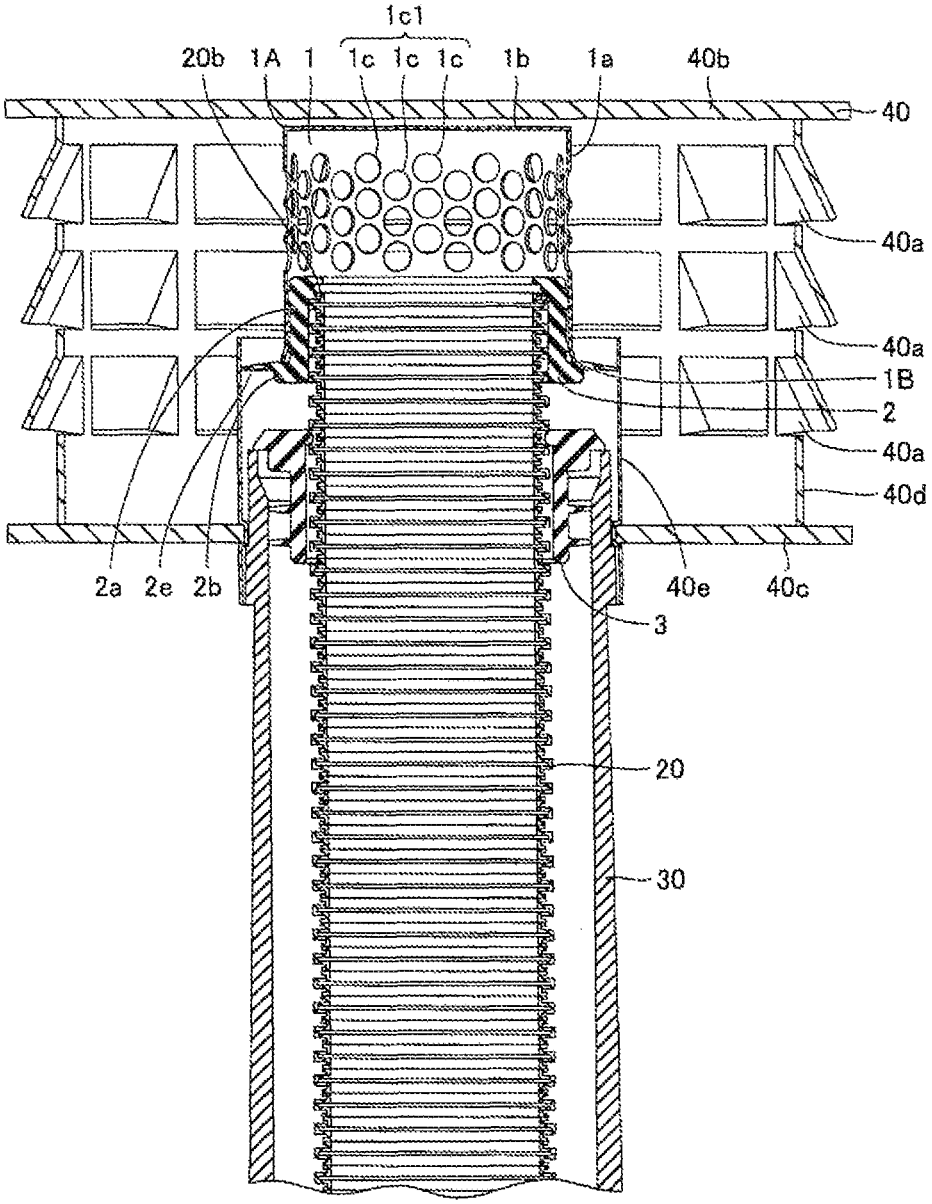
FIG. 15 is a cross-sectional view schematically showing a construction of the exhaust structure for water heater in Embodiment 5 of the present invention.

Referring to FIGS. 14 and 15, exhaust structure for water heater 100 in the present embodiment is different in construction from Embodiment 1 in having a flange portion 2*e* projecting further toward the outer circumference from an outer circumferential surface of annular portion 2*b* of holding member 2. This flange portion 2*e* has a circular shape, and is arranged to abut to the entire circumference of the inner circumferential surface of connection pipe portion 40*e* of exhaust terminal 40 as shown in FIG. 15.

Since exhaust structure for water heater 100 in the present embodiment is otherwise substantially the same in construction as Embodiment 1, the same elements have the same reference characters allotted and description thereof will not be repeated.

The combustion gas emitted from exhaust straightening member 1 into exhaust terminal 40 may be introduced in between the inner circumferential surface of connection pipe portion 40*e* and the outer circumferential surface of holding member 2, which may result in condensation in a lower portion of connection pipe portion 40*e*. In this case, drainage water caused by the condensation may drop toward water heater 50 as passing between the inner circumferential surface of exhaust pipe 30 and the outer circumferential surface of exhaust tube 20.

In the present embodiment, as shown in FIG. 15, flange portion 2*e* abuts to the entire circumference of the inner circumferential surface of connection pipe portion 40*e*. Thus, flange portion 2*e* suppresses leakage of drainage water and the combustion gas from between connection pipe portion 40*e* and holding member 2 and entry of the combustion gas in between the inner circumferential surface of connection pipe portion 40*e* located below flange portion 2*e* and the outer circumferential surface of holding member 2 can be suppressed. Therefore, condensation in the lower portion of connection pipe portion 40*e* can be suppressed, and drop of drainage water produced due to condensation toward water heater 50 as passing between the inner circumferential surface of exhaust pipe 30 and the outer circumferential surface of exhaust tube 20 can be suppressed.

Exhaust tube 20 is prone to wind in a state before installation and it may bend at a tip end. In the present embodiment, since flange portion 2*e* of holding member 2 attached to the other end portion 20*b* of exhaust tube 20 abuts to the inner circumferential surface of connection pipe portion 40*e*, a position of the other end portion 20*b* of exhaust tube 20 which is prone to wind can also be stabilized within connection pipe portion 40*e*.

The present embodiment can also obtain an effect the same as in Embodiment 1 above.

Embodiment 6

A construction of an exhaust structure for water heater in Embodiment 6 will now be described with reference to FIGS. 16 and 17.

Figure 16:
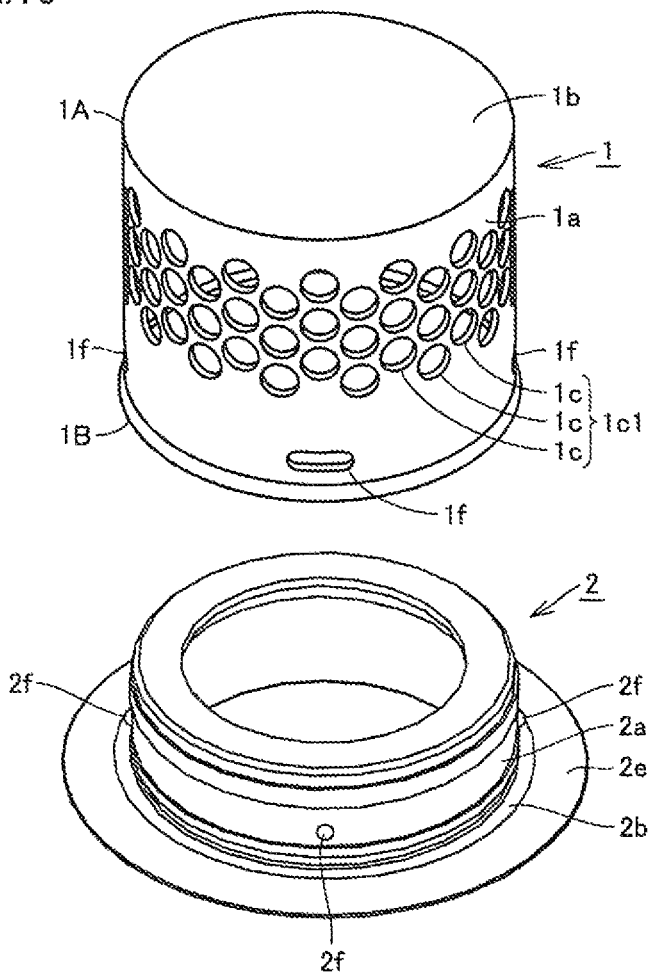
FIG. 16 is an exploded perspective view schematically showing a construction of an exhaust straightening member and a holding member included in an exhaust structure for water heater in Embodiment 6 of the present invention.
Figure 17:
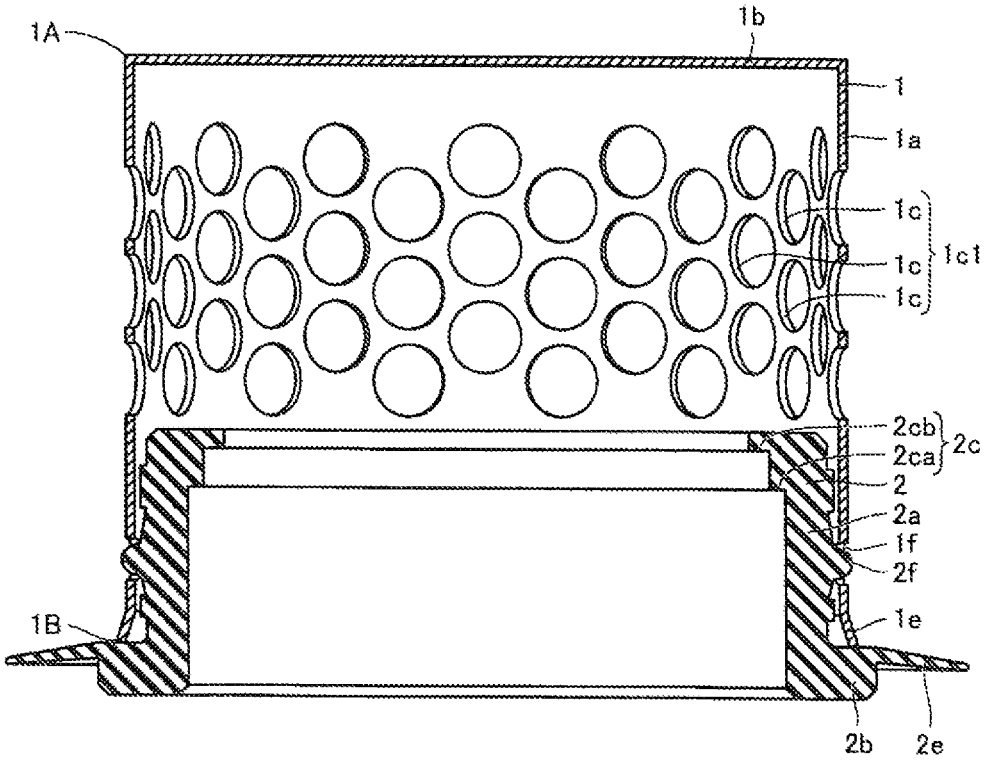
FIG. 17 is a cross-sectional view schematically showing the construction of the exhaust straightening member and the holding member included in the exhaust structure for water heater in Embodiment 6 of the present invention.

Referring to FIGS. 16 and 17, exhaust structure for water heater 100 in the present embodiment is different in construction from Embodiment 5 in having engagement portions 1*f* and 2*f* for positioning of exhaust straightening member 1 and holding member 2 relative to each other and fixing of the same to each other. Exhaust straightening member 1 has a through hole 1*f* as an engagement portion for positioning relative to holding member 2 and fixing thereto. Holding member 2 has a protruding portion 2*f* as an engagement portion for positioning relative to exhaust straightening member 1 and fixing thereto. In attaching exhaust straightening member 1 to holding member 2, protruding portion 2*f* of holding member 2 is fitted into through hole 1*f* in exhaust straightening member 1, so that exhaust straightening member 1 and holding member 2 can be positioned relative to each other and fixed to each other.

Though a case that exhaust straightening member 1 has through hole 1*f* and holding member 2 has protruding portion 2*f* has been described above, exhaust straightening member 1 should only have an engagement portion which is any one of a projection and a recess and holding member 2 should only have an engagement portion which is any other of the projection and the recess. Therefore, a protruding portion may be provided as one engagement portion in exhaust straightening member 1, and a recess may be provided as the other engagement portion in holding member 2.

Figure 18:
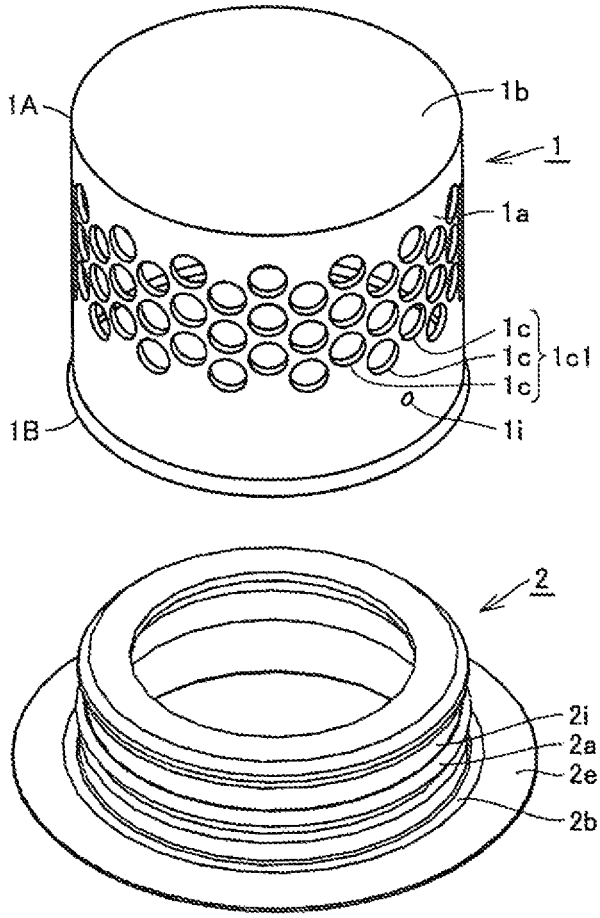
FIG. 18 is an exploded perspective view schematically showing another construction of an exhaust straightening member and a holding member included in the exhaust structure for water heater in Embodiment 6 of the present invention.
Figure 19:
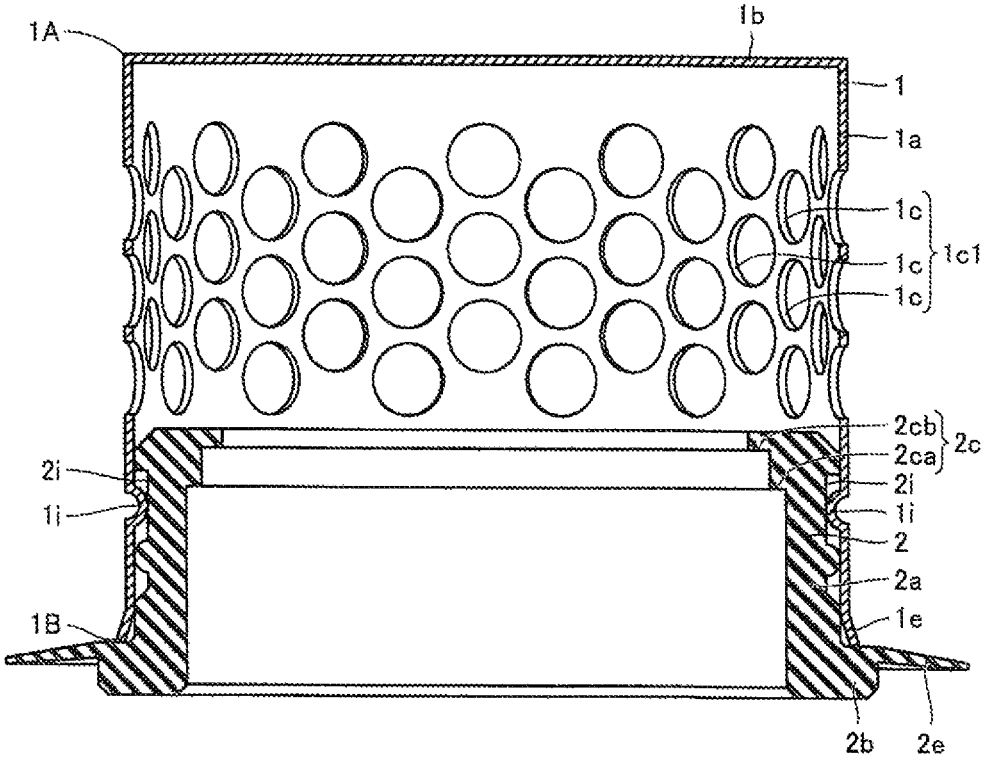
FIG. 19 is a cross-sectional view schematically showing another construction of the exhaust straightening member and the holding member included in the exhaust structure for water heater in Embodiment 6 of the present invention.

Specifically, as shown in FIGS. 18 and 19, a protruding portion 1*i* protruding from the inner circumferential surface of circumferential wall portion 1*a* of exhaust straightening member 1 toward the inner circumference is provided, and a ring-shaped recess 2*i* recessed toward the inner circumference in the outer circumferential surface of cylindrical portion 2*a* of holding member 2 may be provided. A plurality of (for example, two) protruding portions 1*i* may be arranged along a circumferential direction. In attaching exhaust straightening member 1 to holding member 2, protruding portion 1*i* of exhaust straightening member 1 is fitted into ring-shaped recess 2*i* in holding member 2 as shown in FIG. 19, so that exhaust straightening member 1 and holding member 2 can be positioned relative to each other and fixed to each other.

Since exhaust structure for water heater 100 in the present embodiment is otherwise substantially the same in construction as Embodiment 5, the same elements have the same reference characters allotted and description thereof will not be repeated.

In the present embodiment, owing to engagement between through hole 1*f* (recess) in exhaust straightening member 1 and protruding portion 2*f* (projection) of holding member 2 or engagement between protruding portion 1*i* (projection) of exhaust straightening member 1 and ring-shaped recess 2*i* (recess) in holding member 2, exhaust straightening member 1 and holding member 2 can be positioned relative to each other and fixed securely to each other. Therefore, even though holding member 2 made, for example, of such a material as rubber is degraded due to long-term use, separation of exhaust straightening member 1 from holding member 2 can be suppressed.

The present embodiment can also obtain an effect the same as in Embodiment 1 above.

Embodiment 7

A construction of an exhaust structure for water heater in Embodiment 7 will now be described with reference to FIG. 20.

Figure 20:
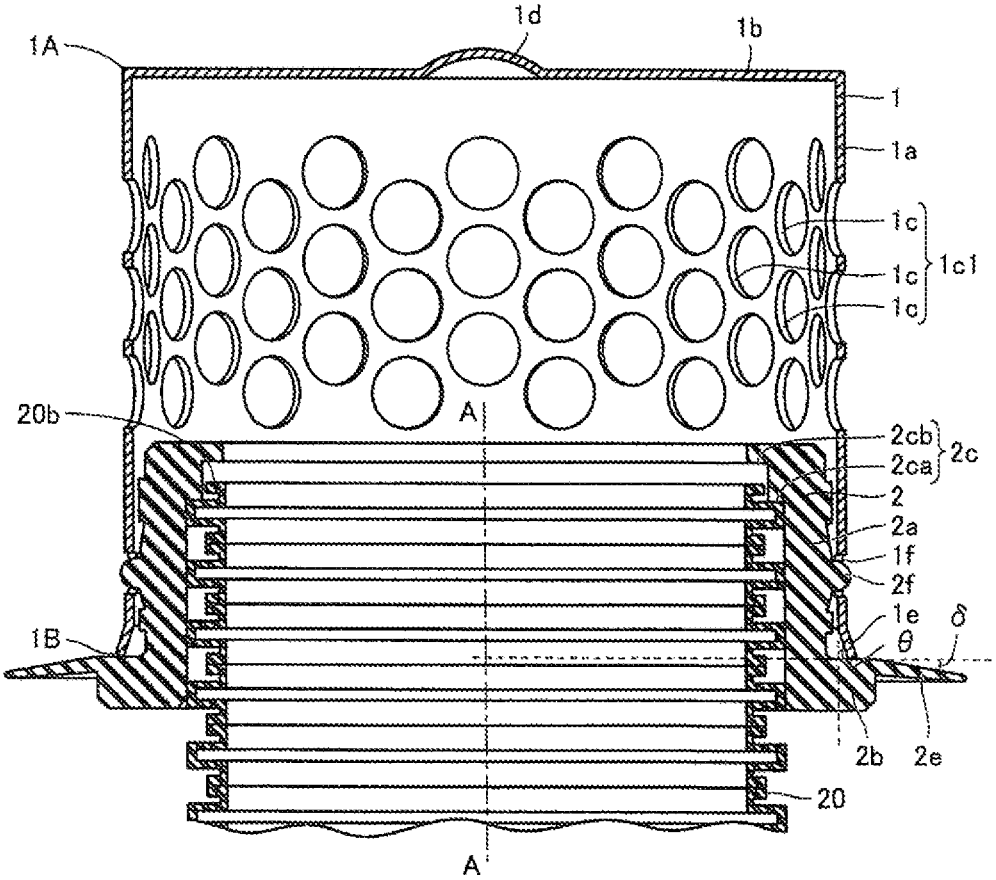
FIG. 20 is a cross-sectional view schematically showing a construction of an exhaust straightening member and a holding member included in an exhaust structure for water heater in Embodiment 7 of the present invention.

Referring to FIG. 20, exhaust structure for water heater 100 in the present embodiment is such that protruding portion 1*d* described in Embodiment 2 is formed in the construction in Embodiment 6. In this construction, circumferential wall portion 1*a* of exhaust straightening member 1 preferably has the other end part 1*e* having a shape flaring toward the other end 1B of circumferential wall portion 1*a* as spreading out toward the outer circumference. The other end part 1*e* is inclined as spreading outward at a prescribed angle θ with respect to a direction of extension (a central axial line (A-A) of exhaust straightening member 1) of other portions of circumferential wall portion 1*a* in a cross-section shown in FIG. 20.

Thus, the other end part 1*e* of circumferential wall portion 1*a* is formed in a flaring shape so that an inner diameter of the other end 1B of circumferential wall portion 1*a* increases. Therefore, in introducing holding member 2 into circumferential wall portion 1*a* from the other end 1B side, holding member 2 is less likely to impinge on the other end 1B of circumferential wall portion 1*a* and introduction thereof is facilitated.

Holding member 2 preferably has a projection portion 2*c* projecting toward the inner circumference, on a circumferential surface of a through hole for introduction of exhaust tube 20. Projection portion 2*c* abuts to the other end portion 20*b* of exhaust tube 20. Specifically, projection portion 2*c* has an abutment portion 2*ca* projecting toward the inner circumference from the inner circumferential surface of cylindrical portion 2*a* and an abutment portion 2*cb* projecting further toward the inner circumference relative to abutment portion 2*ca*. Abutment portion 2*ca* is a portion abutting to a portion on the outer circumferential side of projections and recesses provided in the outer circumferential surface of exhaust tube 20 (accordion projections in the case of the accordion pipe). Abutment portion 2*cb* is a portion abutting to a portion on the inner circumferential side of projections and recesses provided in the outer circumferential surface of exhaust tube 20 (accordion recesses in the case of the accordion pipe).

Thus, in introducing exhaust tube 20 into the through hole in holding member 2, by introducing exhaust tube 20 as far as a position where exhaust tube 20 abuts to projection portion 2*c*, exhaust tube 20 can be positioned relative to holding member 2. As exhaust tube 20 abuts to projection portion 2*c*, leakage of the combustion gas from between exhaust tube 20 and holding member 2 is less likely.

A surface of flange portion 2*e* on the side of the other end portion 20*b* in holding member 2 is a surface inclined such that the outer circumferential side is close toward one end portion 20*a* while holding member 2 is attached to exhaust tube 20. A surface of this flange portion 2*e* on the side of the other end portion 20*b* is a surface inclined at a prescribed angle δ with respect to a virtual line orthogonal to the central axial line (A-A) of holding member 2, such that the outer circumferential side is close toward one end portion 20*a* from the side of the other end portion 20*b*.

Thus, flange portion 2*e* abutting to the inner circumferential surface of connection pipe portion 40*e* of exhaust terminal 40 has the inclined surface as above, so that ease in introduction of holding member 2 in introduction of holding member 2 into connection pipe portion 40*e* is improved.

Since exhaust structure for water heater 100 in the present embodiment is otherwise substantially the same in construction as Embodiment 6, the same elements have the same reference characters allotted and description thereof will not be repeated.

Figure 21:
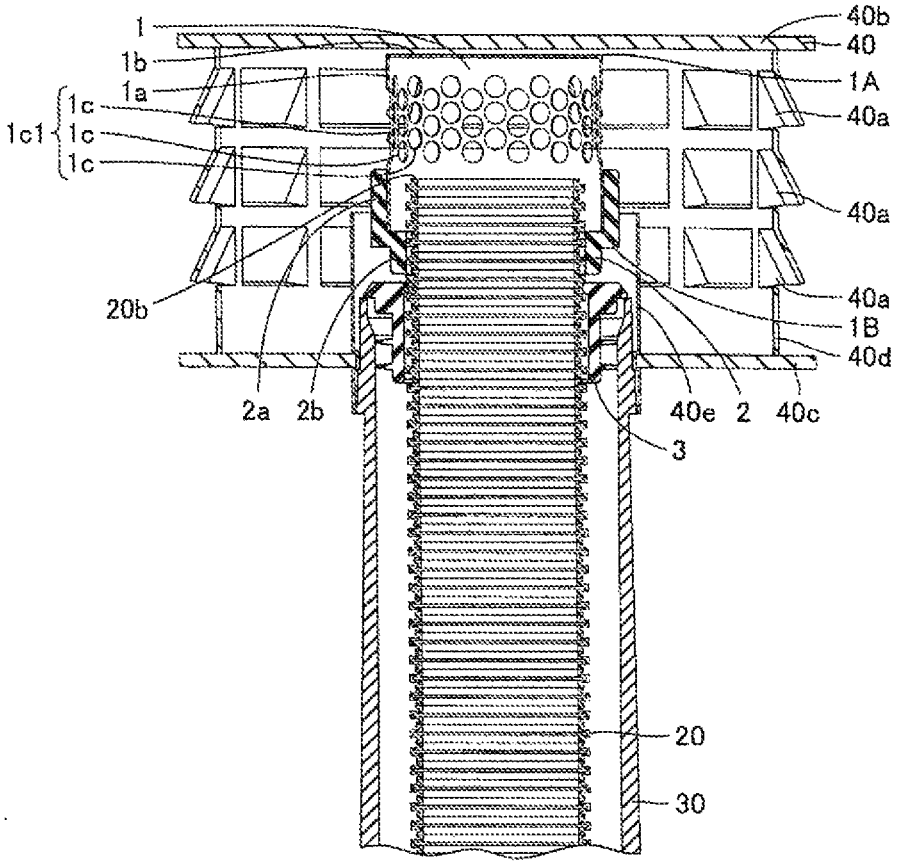
FIG. 21 is a cross-sectional view schematically showing such a construction that a holding member is fitted on an outer circumferential side of an exhaust straightening member.
Figure 22:
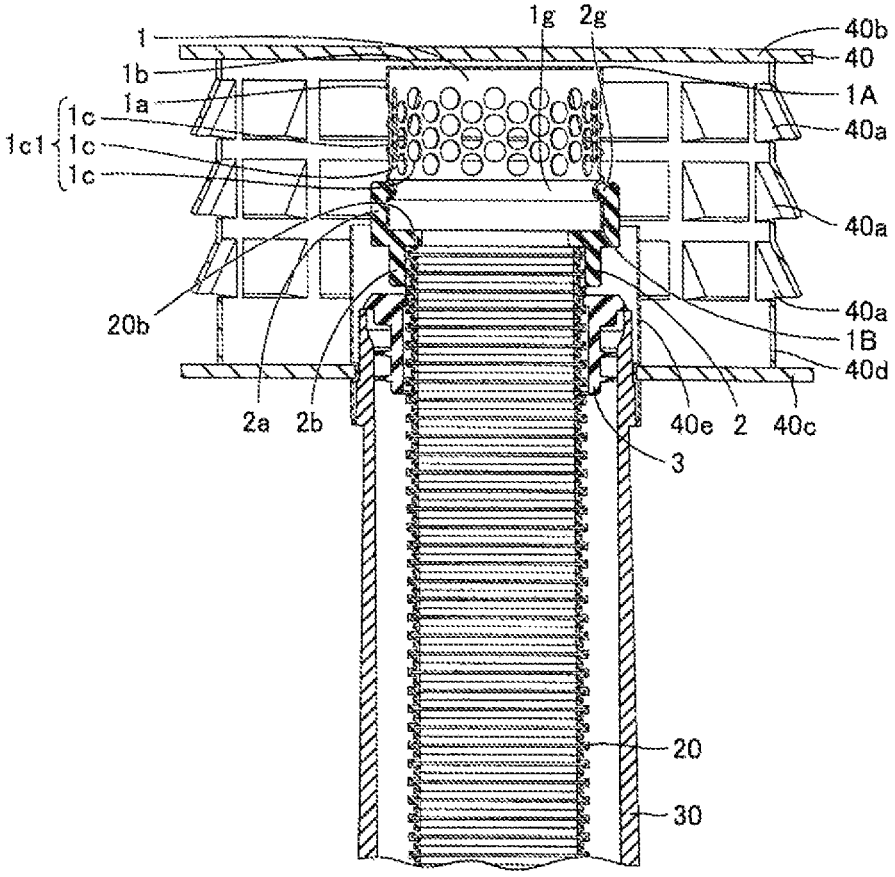
FIG. 22 is a cross-sectional view schematically showing another construction that a holding member is fitted on an outer circumferential side of an exhaust straightening member.

Though a construction in which holding member 2 is fitted to the inner circumferential side of exhaust straightening member 1 has been described in Embodiments 1 to 7 above, holding member 2 may be fitted to the outer circumferential side of exhaust straightening member 1 as shown in FIGS. 21 and 22.

Referring to FIG. 21, holding member 2 is fitted to the outer circumferential side of exhaust straightening member 1. Therefore, the inner circumferential surface of holding member 2 abuts to the outer circumferential surface of exhaust straightening member 1. With this construction as well, an effect the same as in Embodiment 1 above can be obtained.

Referring to FIG. 22, in a construction in which holding member 2 is fitted to the outer circumferential side of exhaust straightening member 1, a projecting rib 2*g* provided on the inner circumferential surface of holding member 2 is fitted into a groove 1*g* provided in the outer circumferential surface of exhaust straightening member 1. Thus, as in Embodiment 6 above, engagement between groove 1*g* in exhaust straightening member 1 and rib 2*g* on holding member 2 can allow positioning of exhaust straightening member 1 and holding member 2 relative to each other and secure fixing of the same to each other. Therefore, even though holding member 2 made, for example, of such a material as rubber is degraded due to long-term use, separation of exhaust straightening member 1 from holding member 2 can be suppressed.

Since FIGS. 21 and 22 are otherwise substantially the same in construction as Embodiment 1, the same elements have the same reference characters allotted and description thereof will not be repeated.

A method of installing exhaust structure for water heater 100 in the present embodiment will now be described with reference to the construction in Embodiment 7 by way of example.

Figure 23:
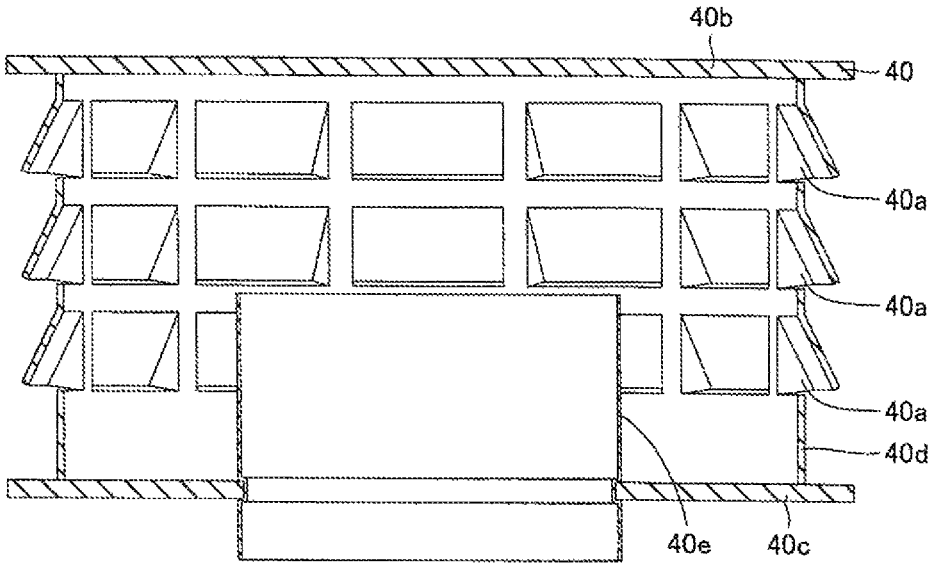
FIG. 23 is a cross-sectional view schematically showing a first step of a method of installing the exhaust structure for water heater in Embodiment 7 of the present invention.
Figure 23:
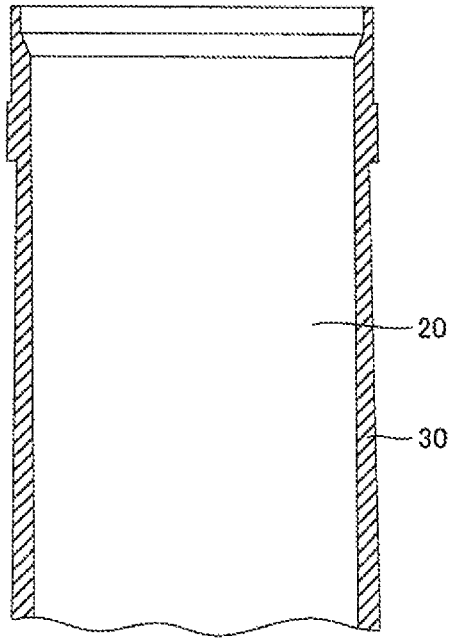

Referring to FIG. 23, initially, a worker gets on top of a roof of a building and removes exhaust terminal 40 from exhaust pipe 30 already placed in the building.

Figure 24:
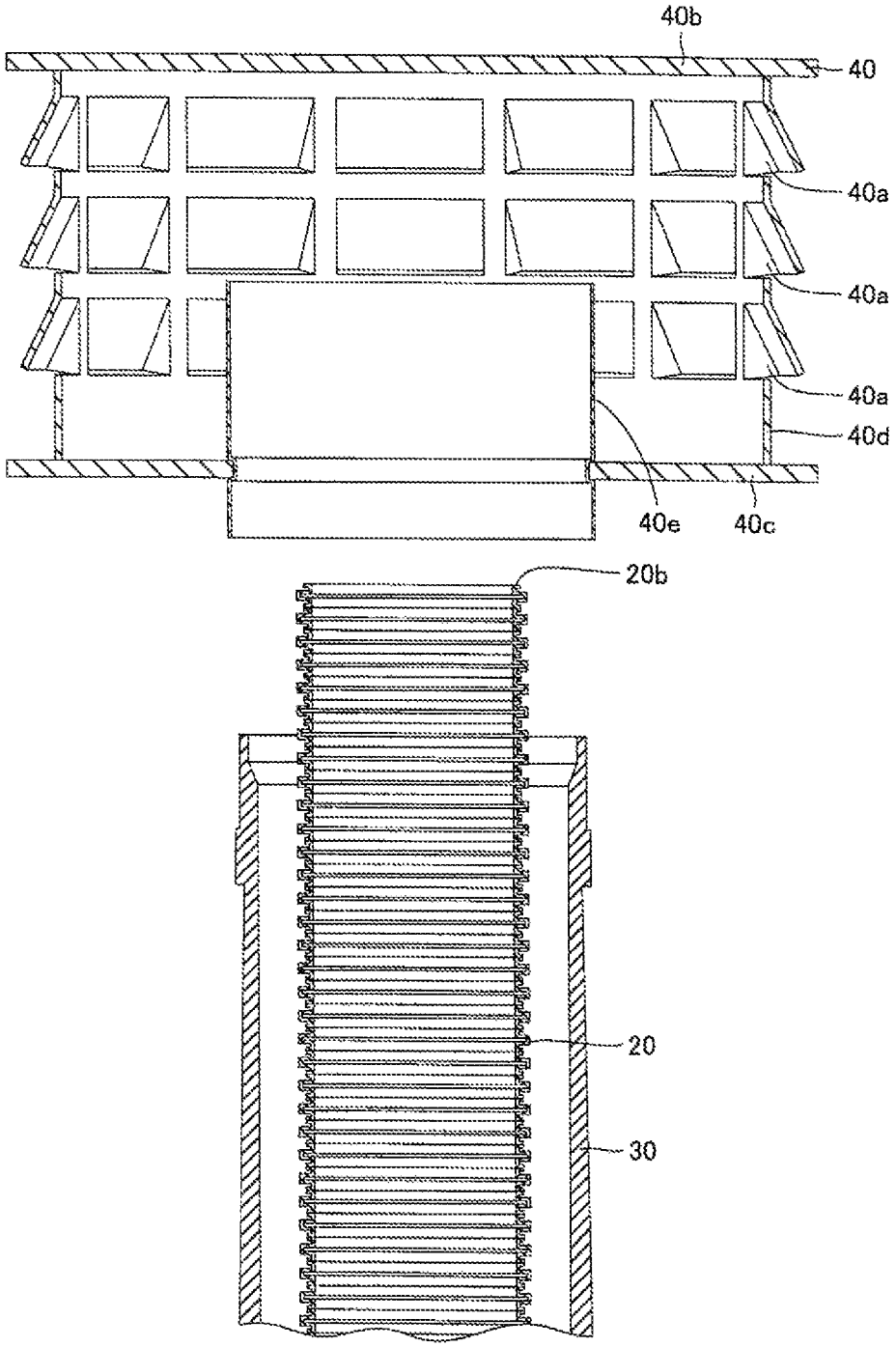
FIG. 24 is a cross-sectional view schematically showing a second step of the method of installing the exhaust structure for water heater in Embodiment 7 of the present invention.

Referring to FIG. 24, after the worker removes exhaust terminal 40 from exhaust pipe 30, he/she inserts exhaust tube 20 into exhaust pipe 30 from the inside of the building. While the other end portion 20*b* of exhaust tube 20 protrudes from the end portion of exhaust pipe 30, exhaust tube 20 is provisionally fixed and this state is held.

Figure 25:
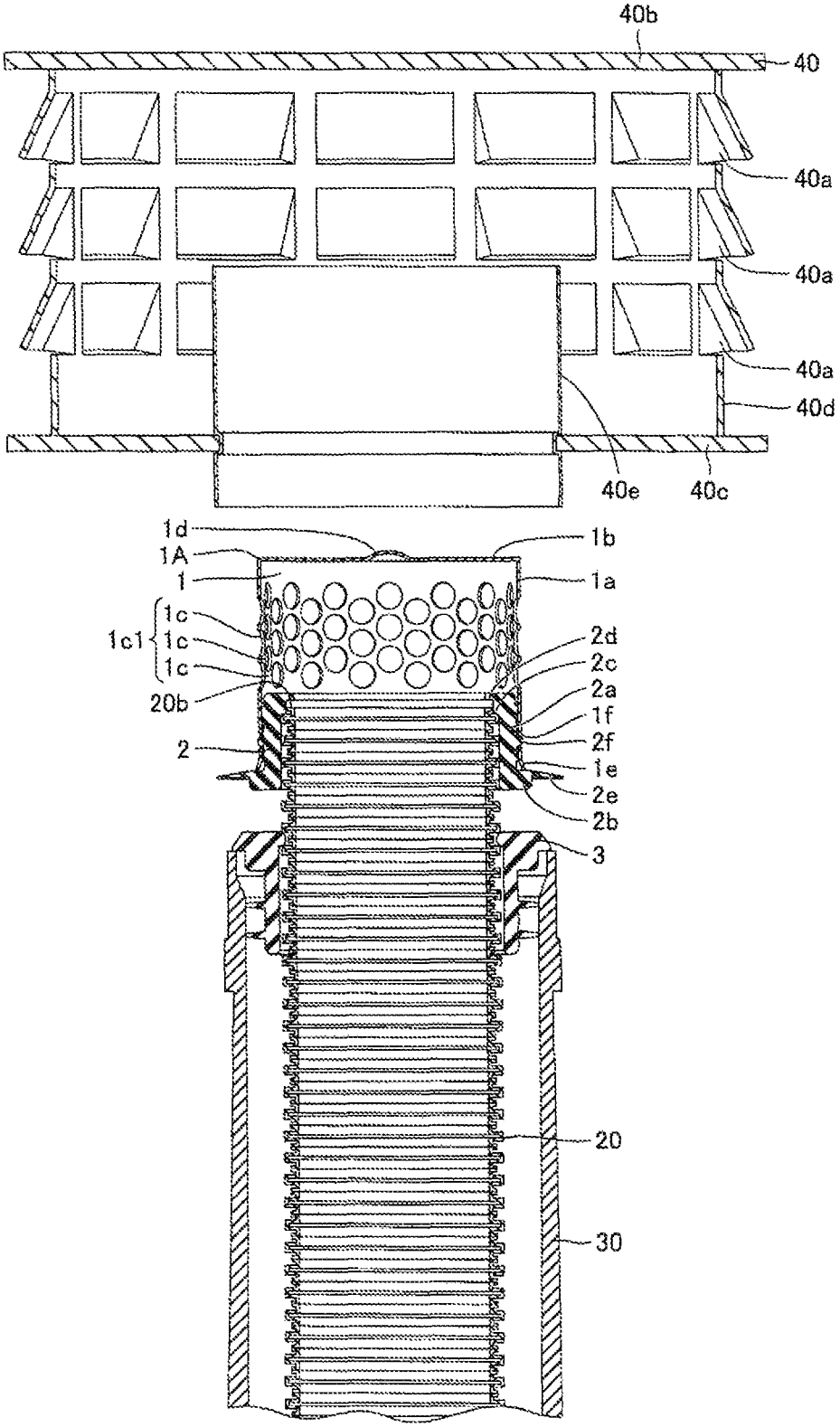
FIG. 25 is a cross-sectional view schematically showing a third step of the method of installing the exhaust structure for water heater in Embodiment 7 of the present invention.

Referring to FIG. 25, exhaust adapter 3 is attached between exhaust tube 20 and exhaust pipe 30 and exhaust straightening member 1 is attached to the other end portion 20*b* of exhaust tube 20 with holding member 2 being interposed. Thereafter, exhaust terminal 40 is attached to exhaust pipe 30 and one end portion of exhaust tube 20 is connected to connection pipe 56 (FIG. 4) of water heater 50. Thus, installation of exhaust structure for water heater 100 in the present embodiment is completed. In the above, the step of removing exhaust terminal 40 and the step of introducing exhaust tube 20 in exhaust pipe 30 may be reversed in order.

Though the method of installation above has been described with reference to Embodiment 7 by way of example, the method is similarly applicable also to the constructions in Embodiments 1 to 6 and FIGS. 21 and 22.

The constructions in Embodiments 1 to 7 above may be combined as appropriate, or the constructions in Embodiments 1 to 7 may be combined with the embodiments shown in FIGS. 21 and 22 as necessary.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An exhaust structure for a water heater heating water with a combustion gas, comprising:

an exhaust tube including an indoor end portion and an outdoor end portion and connected to said water heater at said indoor end portion, the inside of which is defined as an emission path for said combustion gas;

an exhaust pipe greater in outer diameter than said exhaust tube, a part of said exhaust tube being introduced in the exhaust pipe;

an exhaust terminal attached to an end portion of said exhaust pipe and having an exhaust port for exhausting said combustion gas to outside; and an exhaust straightening member attached to said outdoor end portion of said exhaust tube and having an opening portion for allowing said combustion gas to flow out toward said exhaust port, wherein said exhaust straightening member has a cylindrical circumferential wall portion having a first end and a second end and a lid portion closing said first end of said circumferential wall portion, said opening portion has a plurality of openings formed in said circumferential wall portion, the exhaust terminal has a circumferential wall and a ceiling wall attached to an upper end of the circumferential wall, the exhaust straightening member is configured to be arranged in the exhaust terminal so that the lid portion is positioned in a space defined by the ceiling wall and the circumferential wall of the exhaust terminal, the water heater is placed inside a building, the exhaust tube is implemented as a flexible pipe, the exhaust tube and the exhaust pipe extend from an inside of the building to an outside of the building, and there is a gap between an inner circumferential surface of the exhaust pipe and an outer circumferential surface of the exhaust tube.

2. The exhaust structure for the water heater according to claim 1, wherein said lid portion has a protruding portion protruding to a side opposite to said circumferential wall portion.

3. The exhaust structure for the water heater according to claim 1, wherein a surface of said lid portion on a side of said circumferential wall portion has a surface inclined from an outer circumference to a center, downwardly toward said second end of said circumferential wall portion.

4. The exhaust structure for the water heater according to claim 1, wherein said exhaust straightening member has a straightening vane attached to an inner circumferential surface of said circumferential wall portion and extending from said inner circumferential surface toward an inner circumference.

5. The exhaust structure for the water heater according to claim 1, wherein said circumferential wall portion has an end part having a shape flaring toward said second end as spreading out toward an outer circumference.

6. An exhaust structure for a water heater heating water with a combustion gas, comprising:

an exhaust tube including an indoor end portion and an outdoor end portion and connected to said water heater at said indoor end portion, the inside of which is defined as an emission path for said combustion gas;

an exhaust pipe greater in outer diameter than said exhaust tube, a part of said exhaust tube being introduced in the exhaust pipe;

an exhaust terminal attached to an end portion of said exhaust pipe and having an exhaust port for exhausting said combustion gas to outside;

an exhaust straightening member attached to said outdoor end portion of said exhaust tube and having an opening portion for allowing said combustion gas to flow out toward said exhaust port, a holding member for attaching said exhaust straightening member to said outdoor end portion of said exhaust tube, wherein said holding member has elasticity, the holding member is provided separately from the exhaust pipe and configured to be in a direct contact with the exhaust tube and the exhaust straightening member, the water heater is placed inside a building, the exhaust tube is implemented as a flexible pipe, the exhaust tube and the exhaust pipe extend from an inside of the building to an outside of the building, and there is a gap between an inner circumferential surface of the exhaust pipe and an outer circumferential surface of the exhaust tube.

7. The exhaust structure for the water heater according to claim 6, wherein said exhaust terminal has a connection pipe portion connected to said exhaust pipe, and said holding member has an outer circumferential surface and a flange portion abutting to an inner circumferential surface of said connection pipe portion as projecting from said outer circumferential surface toward an outer circumference.

8. The exhaust structure for the water heater according to claim 7, wherein a surface of said flange portion on a side of said outdoor end portion is inclined such that an outer circumferential side is closer toward said indoor end portion while said holding member is attached to said exhaust tube.

9. The exhaust structure for the water heater according to claim 6, wherein said exhaust straightening member has one engagement portion which is any one of a projection and a recess and said holding member has the other engagement portion which is any other of said projection and said recess, and said exhaust straightening member and said holding member are positioned and fixed as said other engagement portion is engaged with said one engagement portion.

10. The exhaust structure for the water heater according to claim 6, wherein said holding member has a through hole and has a projection portion projecting toward an inner circumference on a circumferential surface of said through hole, and said projection portion abuts to said outdoor end portion of said exhaust tube.

11. The exhaust structure for the water heater according to claim 1, further comprising an exhaust adapter arranged between the outer circumferential surface of said exhaust tube and the inner circumferential surface of said exhaust pipe and pressing both of said outer circumferential surface of said exhaust tube and said inner circumferential surface of said exhaust pipe.

12. The exhaust structure for the water heater according to claim 6, further comprising an exhaust adapter arranged between the outer circumferential surface of said exhaust tube and the inner circumferential surface of said exhaust pipe and pressing both of said outer circumferential surface of said exhaust tube and said inner circumferential surface of said exhaust pipe.

* * * * *